US006109602A

United States Patent [19]

Schron, Jr. et al.

[11] Patent Number: 6,109,602

[45] Date of Patent: Aug. 29, 2000

[54] CLAMPING DEVICE

[75] Inventors: Jack H. Schron, Jr., Chagrin Falls, Ohio; Jeff L. Summers, Littleton, Colo.

[73] Assignee: Jergens, Inc., Cleveland, Ohio

[21] Appl. No.: 09/273,414

[22] Filed: Mar. 19, 1999

Related U.S. Application Data

[62] Division of application No. 08/925,449, Sep. 8, 1997

[60] Provisional application No. 60/027,533, Oct. 7, 1996.

[51] Int. Cl.[7] ..... B25B 1/06

[52] U.S. Cl. ..... 269/216; 269/20; 269/217; 269/234

[58] Field of Search ..... 269/216, 217, 269/234, 48.1, 238; 29/559

[56] References Cited

U.S. PATENT DOCUMENTS

| | | | |
|---|---|---|---|
| 4,802,661 | 2/1989 | Jewett, Sr. | 269/217 |
| 4,804,171 | 2/1989 | Dornfeld | 269/234 |
| 4,874,156 | 10/1989 | Goldzweig | 269/254 CS |
| 5,197,720 | 3/1993 | Renz et al. | 269/48.1 |
| 5,695,393 | 12/1997 | Granziera | 451/390 |

FOREIGN PATENT DOCUMENTS

| | | |
|---|---|---|
| 59-187470 | 10/1984 | Japan . |
| 5-67434 | 9/1993 | Japan . |

*Primary Examiner*—David A. Scherbel
*Assistant Examiner*—Lee Wilson
*Attorney, Agent, or Firm*—Vickers, Daniels & Young

[57] ABSTRACT

A clamping device for frictional clamping of a workpiece which includes a clamp element adapted to frictionally clamp a workpiece and a mechanism for moving the clamp element which includes a shape memory alloy adapted to move the clamp element when the shape memory alloy is heated. The shape memory alloy moves the clamp element into a clamped state and/or unclamped state upon heating the shape memory alloy. The clamped element is preferably a super elastic alloy which is naturally oriented in a clamped position for a positive clamp and in an unclamped position for a non-positive clamp.

51 Claims, 16 Drawing Sheets

CLAMPING DEVICE

This application claims the benefit of United States Provisional Application Ser. No. 60/027,533, filed on Oct. 7, 1996. This application is a divisional of U.S. Utility Application Ser. No. 08/925,449, filed on Sep. 8, 1997, which claims the benefit of U.S. Provisional Application Ser. No. 60/027,533, filed on Oct. 7, 1996.

The invention relates generally to a device for clamping workpieces and more particularly to a novel and improved clamping device which incorporates a shape memory alloy to clamp and/or unclamp a workpiece.

INCORPORATION BY REFERENCE

U.S. Pat. No. 5,197,720 illustrates the use of a super elastic alloy used in a non-positive clamping device and is incorporated herein by reference.

BACKGROUND OF THE INVENTION

Clamps for releasably holding materials during a manufacture process or the releasable locking of tooling such as dies, fixtures or molding plates are known in the art. Such self-locking clamping devices are illustrated in U.S. Pat. Nos. 4,721,293, RE 32,704 and 5,197,720. In U.S. Pat. No. 4,721,293 and RE 32,704, non-positive locking clamping devices are designed to use a fluid such as air or water to move a piston to clamp a workpiece. In U.S. Pat. No. 5,197,720, a non-positive clamping device is shown which incorporates the use of a super elastic alloy. The '720 patent incorrectly uses the term "shape memory alloy" to identify the super elastic alloy. As discussed below, shape memory alloys are a special class of alloys that have shape memory characteristics when heated, whereas super elastic alloys exhibit shape memory characteristics when physical stresses are applied to the alloys. The super elastic alloy in the '720 patent is designed to be mechanically moved by the use of a fluid to thereby lock a workpiece in position. When the workpiece is to be released, the fluid pressure is reduced thereby allowing the super elastic alloy to revert to its original shape and position thereby unclamping the workpiece.

Non-positive clamping tools can provide adequate clamping when properly operated. However, if a failure occurs which would result in a loss of fluid pressure, the clamping forces dissipate thereby allowing the workpiece to be inadvertently released from the clamp. Furthermore, the non-positive clamping device is typically complex in design and requires sophisticated pumps, seals and overall design to operate. The inherent complexity of this design subjects the design to an increased possibility of failure, i.e. pump, valve fitting or line failures. Positive clamping devices overcome the problems associated with non-positive clamping devices; however, such positive clamping devices have typically required complex designs resulting in a clamp that is difficult to repair when it fails.

In view of the prior art of clamping devices, there is a demand for a clamping device which is easy to manufacture, simple in design, reliable in operation and can clamp and unclamp a wide variety of workpieces.

SUMMARY OF THE INVENTION

In accordance with the present invention, there is provided a novel clamping device for the clamping of a workpiece in position. Preferably, the clamp device is designed for positive clamping; however, the clamp can be alternatively designed for non-positive clamping applications. The clamping device includes a clamping element such as a clamping surface, clamping pin, clamping lock, clamping clip, etc. which is designed to secure and unsecure a workpiece to and from a clamp surface. The clamping element is preferably made of a material strong enough to secure a workpiece in position for a particular type of operation. In addition, the clamping element preferably has flexible properties which allow the clamping element to be moved between a clamped and an unclamped position. The clamping device also preferably includes a mechanism for moving the clamping element into a clamped state or unclamped state to provide for positive clamping or non-positive clamping, respectively. As can be appreciated, the clamping device has a wide variety of applications due to the positive nature or non-positive nature of clamping and further provides a mechanism for easily clamping or unclamping of a workpiece.

In accordance with another aspect of the present invention, the clamping element includes a super elastic alloy. Super elastic alloys are alloys which exhibit super elastic/pseudo elastic shape recovery characteristics. These alloys are characterized by their ability to be transformed from an martensitic crystal structure to a stress induced austenitic structure and return elastically to the martensitic shape when the stress is removed. These alternating crystalline structures provide the alloy with its super elastic properties. Such alloys may include an alloy comprising primarily of In-Tl, Fe-Mn, Ni-Ti, Ag-Cd, Au-Cd, Au-Cu, Cu-Al-Ni, Cu-Au-Zn, Cu-Zn, Cu-Zn-Al, Cu-Zn-Sn, Cu-Zn-Xe, Fe, Be, $Fe_3Pt$, Ni-Ti-V, Fe-Ni-Ti-Co, Cu-Sn and Ni-Ti-Cu. These alloy systems may include small amounts of other metals which improve the super elastic characteristics of the alloy. These alloys are especially suitable for use in clamping devices in that their capacity to elastically recover almost completely to their initial configuration once stress has been removed on the alloy.

In accordance with yet another aspect of the present invention, the super elastic alloy preferably is a separate component of the clamping device and is shaped to provide a force on the clamped element to force the clamped element into a clamped state for positive clamping. Alternatively, or in addition to, the clamping element may be made up of or include a super elastic alloy which is shaped for positive clamping of the workpiece. By designing the clamping element to be or include a super elastic alloy, the clamping element will position itself into a clamped state for positive clamping. An external force is used to move the clamping element into an unclamped state. Once the external force is reduced or removed, the clamping element will elastically move into its original clamped position.

In accordance with still another aspect of the present invention, the clamping device includes a super elastic alloy which is shaped to provide a force on the clamped element to force the clamped element into an unclamped state for non-positive clamping. Alternatively, or in addition to, the clamping element may be made up of or include a super elastic alloy which is shaped for non-positive clamping of a workpiece. By designing the clamping element to be or include a super elastic alloy, the clamping element will position itself in an unclamped state for non-positive clamping. An external force is used to move the clamping element into a clamped state. Once the external force is reduced or removed, the clamping element will elastically move into its original unclamped position.

In accordance with still yet another aspect of the present invention, the mechanism for moving the clamping element into an unclamped state includes the use of a fluid such as gas or liquid to apply a force to the clamping element to cause the clamping element to move into an unclamped state. Preferably, the fluid is at least partially encapsulated in a super elastic alloy. The pressurization of the fluid causes, the super elastic alloy to move thereby causing the clamping element to move into an unclamped state. When the pressure of the fluid is reduced, the force on the clamping element is also reduced thereby allowing the clamping element to return to the clamped state. The clamping element may include and/or be the super elastic alloy or be a separate component. Preferably, the clamping element is or includes a super elastic alloy that is shaped in a natural unclamped position.

In accordance with another aspect of the present invention, the mechanism for moving the clamping element into a clamped state includes the use of a fluid such as a gas or liquid to apply pressure to the clamping element and to cause the clamping element to move into its clamped state. Preferably, the fluid is a compressible fluid sealed in the body of the clamping device. The fluid is pressurized to constantly apply a force to the clamping element to force the clamping element into a clamped state. The fluid is compressible so as to allow the clamped element to be moved out of its clamped state when the mechanism for moving the clamping element out of its clamped state has been activated. The clamping element may include and/or be the super elastic alloy or be a separate component. Preferably, the clamping element is or includes a super elastic alloy that is shaped in a natural clamped position. Once the forces acting to move the clamping element to orient the clamping element in the unclamped state have been removed, the pressurized fluid in the fluid chamber forces the repositioning of the clamping element into its clamped state. Preferably, the fluid is a gas such as air, nitrogen or an inert gas.

In accordance with still another aspect of the present invention, the mechanism for moving the clamping element into a clamped or an unclamped orientation includes the use of a shape memory alloy. Shape memory alloys are alloys which, after being deformed, can recover their original shape when heated. Due to the unique property of these alloys, such alloys upon being heated expand in size and upon being cooled return to essentially the original shape and size. The alloy composition of the shape memory alloy is selected to have a hardness and strength which is sufficient to apply a force when expanded by heat to the clamping element to move the clamping element and clamp a workpiece in position. Such alloys may include an alloy comprising primarily of Ti-Ni, Ti-Ni-Fe, Cu-Zn-Al, and Cu-Al-Ni. These alloy systems may include small amounts of other metals, preferably non-ferrous, which improve the shape memory characteristics of the alloys. One type of shape memory alloy which is particularly applicable to the present invention is a nickel-titanium alloy. Such an alloy exhibits the hardness and strength which is comparable to steel materials, has excellent corrosion resistant properties, excellent strength and has a very high reversible deformation property. In addition, a nickel-titanium alloy has a transformation temperature which can be adjusted between the marstenstitic and austhentic microstructure in a range from −100° to 100° C. by using an appropriate alloy composition. The shape memory alloy is preferably heated by an electric heating element positioned closely adjacent to the shape memory alloy. Upon applying a current to the electrodes, the heating element increases in temperature thereby causing the shape memory alloy to expand. Once the current through the electrodes is terminated, the heat in the heating element dissipates and the shape memory alloy returns to its original size and shape. The heating of the shape memory alloy can alternatively or in combination be heated by electrical resistance heating, fluid heat exchange heating, chemical reaction heating, convection heating and/or radiation heating. The heating of the shape memory alloy causes the clamped element to move and the subsequent cooling of the shape memory alloy allows the clamped element to return to its original position.

In accordance with still yet another aspect of the present invention, the clamping device incorporates a clamping element made up of or including a super elastic alloy which is designed to move into a clamped and/or an unclamped state, and a shape memory alloy to move the clamping element. For a non-positive clamp arrangement, the clamping device clamps a workpiece when the shape memory alloy is heated by forcing the clamping element into the clamped position. The subsequent cooling of the shape memory alloy results in the contracting of the shape memory alloy and allows the clamping element to move into the unclamped position. For a non-positive clamp arrangement, the clamping element preferably is a super elastic alloy having a natural shape corresponding to the unclamped position. For a positive clamp arrangement, the clamping device unclamps a workpiece when the shape memory alloy is heated by forcing the clamping element into the unclamped position. The subsequent cooling of the shape memory alloy results in the contracting of the shape memory alloy and alloys the clamping element to move into the clamped position. For a positive clamp arrangement, the clamping element preferably is a super elastic alloy having a natural shape corresponding to the clamped position.

It is the object of the present invention to develop a clamping device which can clamp a wide variety of workpieces.

It is another object of the present invention to provide a clamping device which is cost effective and easy to manufacture and which device has a durable, reliable and simple design to ensure the proper clamping of a workpiece.

It is still another object of the present invention to include a super elastic alloy in a clamping device which super elastic alloy is designed to clamp and/or unclamp a workpiece in place.

It is still yet another object of the present invention to provide a shape memory alloy in a clamping device, which alloy upon heating expands in size, wherein the shape memory alloy moves into a clamped and/or unclamped position when the shape memory alloy is heated.

It is yet another object of the present invention to provide a clamping device which includes a shape memory alloy and a super elastic alloy wherein the shape memory alloy applies a force upon heating to the super elastic alloy to cause the super elastic alloy to move into a clamped and/or unclamped position.

It is another object of the present invention to provide a clamping device which includes a shape memory alloy wherein the shape memory alloy clamps and/or unclamps a workpiece upon being heated.

These and other objects and advantages will become apparent to those skilled in the art upon reading the following description taking together with the preferred embodiments disclosed in the accompanied drawings.

BRIEF DESCRIPTION OF THE DRAWINGS

Reference may now be made to the drawings, which illustrate various preferred embodiments that the invention may take in physical form and in certain parts and arrangements of parts wherein.

DETAILED DESCRIPTION OF THE PREFERRED EMBODIMENTS

Figure 1:
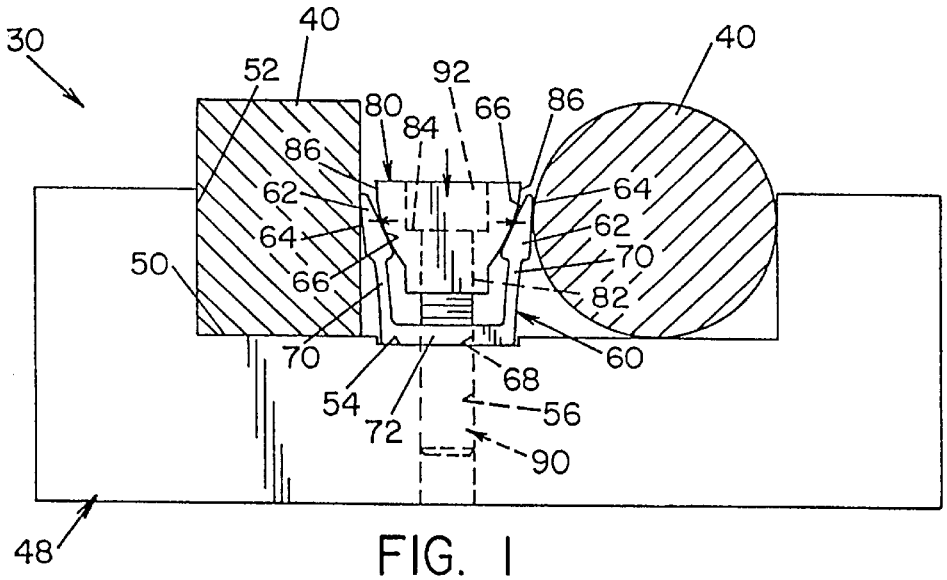
FIG. 1 (PRIOR ART)
FIG. 1 is a plan view of a prior art non-positive clamping device.

Referring now to the drawings wherein the showings are for the purpose of illustrating preferred embodiments of the invention only and not for the purpose of limiting the same, an improved clamping device is provided which incorporates the use of a shape memory alloy to clamp and/or unclamp a workpiece to significantly improve the reliability of clamping in both a positive clamping or non-positive clamping configuration. Shape memory alloys are known for their unique quality for retaining their original shape upon being heated below their critical temperature and subsequently cooled. Another unique feature of shape memory alloys is that upon heating, the alloy increases in volume and upon subsequent cooling, returns to its original volume and shape. These unique qualities of shape memory alloys can be advantageously used to clamp and/or unclamp a workpiece. One type of shape memory alloy which is of particular interest for use in a clamp is a nickel titanium alloy. Such an alloy is very durable and strong and is ideal for use in a clamp. One specific type of shape memory alloy is a titanium-nickel alloy manufactured by Raychem and identified as TINEL® alloy K.

In addition to the incorporation of a shape memory alloy in a clamp device, the use of a super elastic alloy in combination with a shape memory alloy has been found to form both positive and non-positive clamps which were, until now, unavailable. Super elastic alloys are a unique type of alloy which retain their original shape qualities even after being forced to move into a non-natural shape. For instance, a super elastic alloy having a naturally occurring planar shape that is forced into a slightly arcuate shape, will return to its original planar shape once the force is removed from the super elastic alloy. As can be appreciated, this unique physical property of super elastic alloys is highly beneficial to various types of clamping devices. One particular type of super elastic alloy which is preferably used in clamping devices is a nickel-titanium alloy manufactured by NDC and identified as Nitanol Se 10. Nickel titanium alloys are alloys exhibiting excellent durability and high strength properties.

A shape memory alloy or a shape memory alloy and a super elastic alloy can be used in many types and designs of clamps. In one type of clamp arrangement, the clamp is a non-positive clamp which is defined as a clamp which requires the shape memory alloy to be heated so as to clamp a workpiece in position. When the shape memory alloy is not heated, the clamp is in an unclamped position therefore allowing the workpiece to be non-securely inserted into and/or removed from the clamp arrangement. The shape memory alloy can be positioned in the clamp arrangement such as to directly contact the workpiece upon expansion thereby clamping the workpiece in position or the shape memory alloy can cause another piece of the clamp arrangement to engage the workpiece during clamping. As can be appreciated, such a clamp design can be a simple yet effective design to clamp a workpiece. Due to the special nature of the shape memory alloys, the increase in heat of the shape memory alloy causes the shape memory alloy to further expand. Therefore, the clamping force applied to a workpiece is a function of the amount of heat being applied to the shape memory alloy. This additional feature of the shape memory alloy can be incorporated into an automated control mechanism whereby the desired amount of clamping force applied by the shape memory alloy can be selected by supplying a specific amount of heat to the shape memory alloy. Preferably, the heat source to the shape memory alloy is by electric resistance heating a heating element positioned adjacent to the alloy by an electric current. However, other sources of heat to the shape memory alloy can include electric resistance heating, radiation heating, heat from a chemical reaction or by some form of convection heating.

In another type of clamping arrangement, the shape memory alloy can be used in a positive clamping configuration so that when the shape memory alloy is heated, the shape memory alloy causes the workpiece to become unsecured from the clamp. In one such arrangement, a workpiece is held in position by a clamping element which is biased in a clamping position by a spring. The shape memory alloy is positioned relative to the clamping element such that when the shape memory alloy is heated, the shape memory alloy counteracts the force of the spring thereby causing the clamping element to reduce the force being applied to the workpiece thereby allowing the workpiece to be removed from the clamp arrangement. As can be appreciated, a number of clamping arrangements can be used which incorporates a shape memory alloy in a positive and non-positive clamping arrangement.

The clamping arrangements which include both a shape memory alloy and a super elastic alloy further increase the number of different types of clamping arrangements for both positive and non-positive clamps. When a super elastic alloy is incorporated in the clamping arrangement, the super elastic alloy is preferably in the form of the clamping element which is designed to directly contact the workpiece and hold the workpiece in a clamped position. For non-positive clamping arrangements, the natural shape of the super elastic alloy is in the shape of an unclamped position to allow the workpiece to be unsecuredly inserted into and removed from the clamping arrangement. The shape memory alloy is positioned with respect to the super elastic alloy such that when the shape memory alloy is heated, the shape memory alloy directly and/or indirectly applies a force to the super elastic alloy thereby causing the super elastic alloy to deform into a clamped position to secure the workpiece. When the shape memory alloy is cooled, the shape memory alloy returns to its original shape and form thereby removing the deforming forces on the super elastic alloy, which in turn results in the super elastic alloy returning to its natural unclamped position. As can be appreciated, a similar arrangement can be used for a positive clamping arrangement. For a positive clamping arrangement, the super elastic alloy is shaped such that its natural shape or orientation is in the clamped state thereby securing the workpiece securely to the clamp. Therefore, the workpiece can only be removed from the clamp when the shape memory alloy is heated which in turn applies a force directly and/or indirectly on the super elastic alloy which causes the super elastic alloy to deform in shape into the unclamped position thereby allowing the workpiece to be removed from the clamp. As can be appreciated, there are many clamp arrangements which can incorporate a super elastic alloy and a shape memory alloy to form a positive or non-positive clamp arrangement.

Reference will now be made to specific applications for a clamp arrangement which incorporates a shape memory alloy and/or a super elastic alloy in a positive clamp arrangement. FIG. 1 illustrates a prior art non-positive clamping arrangement. Clamping arrangement 30 clamps a workpiece 40 to the clamp body 48 by using a clamping element 60. Workpiece 40 is positioned onto clamp body 48 and arranged such that one surface of the workpiece is positioned against clamp base surface 50 and another portion of the workpiece is positioned against clamp side surface 52. The clamp body also includes a clamp element cavity 54 positioned adjacent to the workpiece. Clamp base 72 of the clamping element is partially inserted into the clamp element cavity 54. The clamp element includes two legs 70 extending from each end of clamp base 72. At the end of each clamp leg 70 is a clamp head 62 which includes a clamp surface 64 and a wedging surface 66. Clamping element 60 is positioned into the clamp element cavity 54 such that the clamping surface 64 is positioned closely adjacent to workpiece 40. A clamp wedge is inserted between the two clamp heads 62 such that the wedge face 86 engages the wedging surfaces 66 of clamp heads 62. The clamp wedge includes a wedge hole 82 which extends through clamp wedge 80 and is adapted to receive a bolt 90. Bolt 90 extends through the clamp wedge and continues through the clamp hole 68 of clamping element 60 and into fastener cavity 56 of clamp body. The end of bolt 90 preferably is threaded so that it can be secured into fastener cavity 56. At the top of bolt 90 is a bolt head 92 which has a larger diameter than the remaining section of bolt 90. Bolt head 92 is designed to engage hole landing 84 in clamp wedge 80. Workpiece 40 is secured to clamp body 48 by screwing bolt 90 into fastener cavity 56 which causes bolt head 92 to engage hole landing 84 thereby forcing clamping wedge 80 toward clamp base 72. As clamp wedge 80 is forced toward clamp base 72, wedge face 86 applies pressure to wedging surface 66 which in turn causes clamp surface 64 to engage workpiece 40. Bolt 90 is screwed into fastener cavity 56 until a sufficient force is being applied by clamp surface 64 against workpiece 40 to adequately clamp workpiece 40 to clamp body 48.

Figure 2:
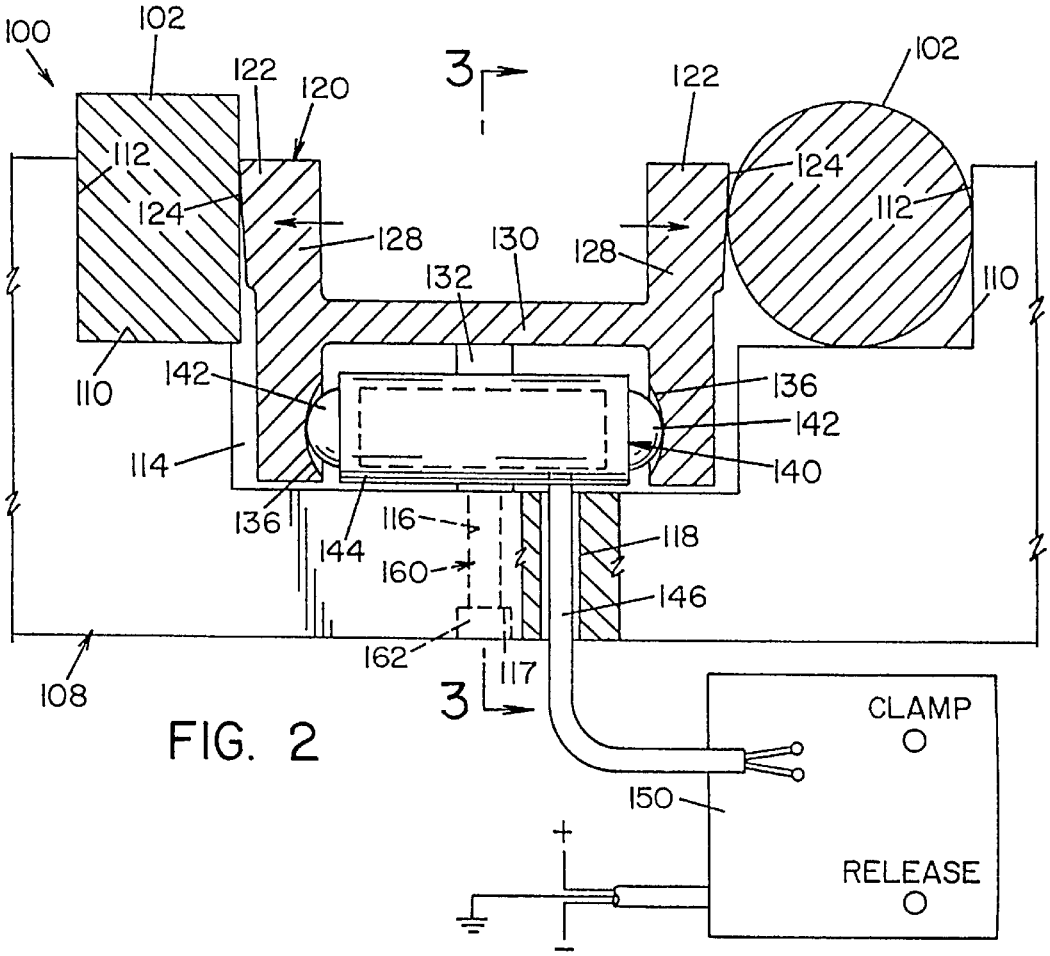
FIG. 2 is a plan view of a positive clamping device in accordance with the present invention.
Figure 3:
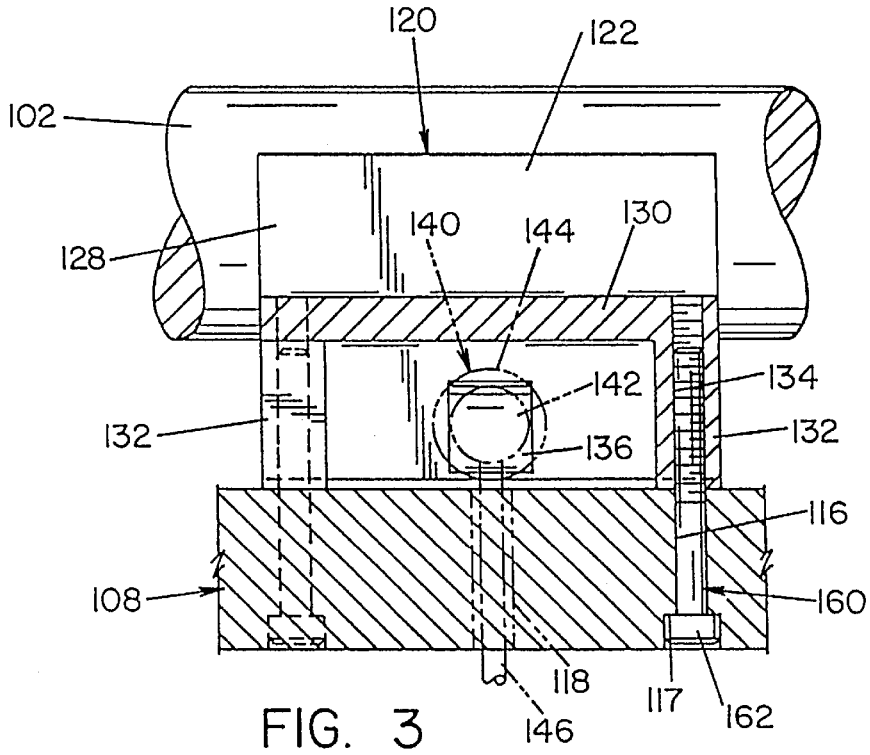
FIG. 3 is a cross-sectional view taken along line 3:3 of FIG. 2.
Figure 4:
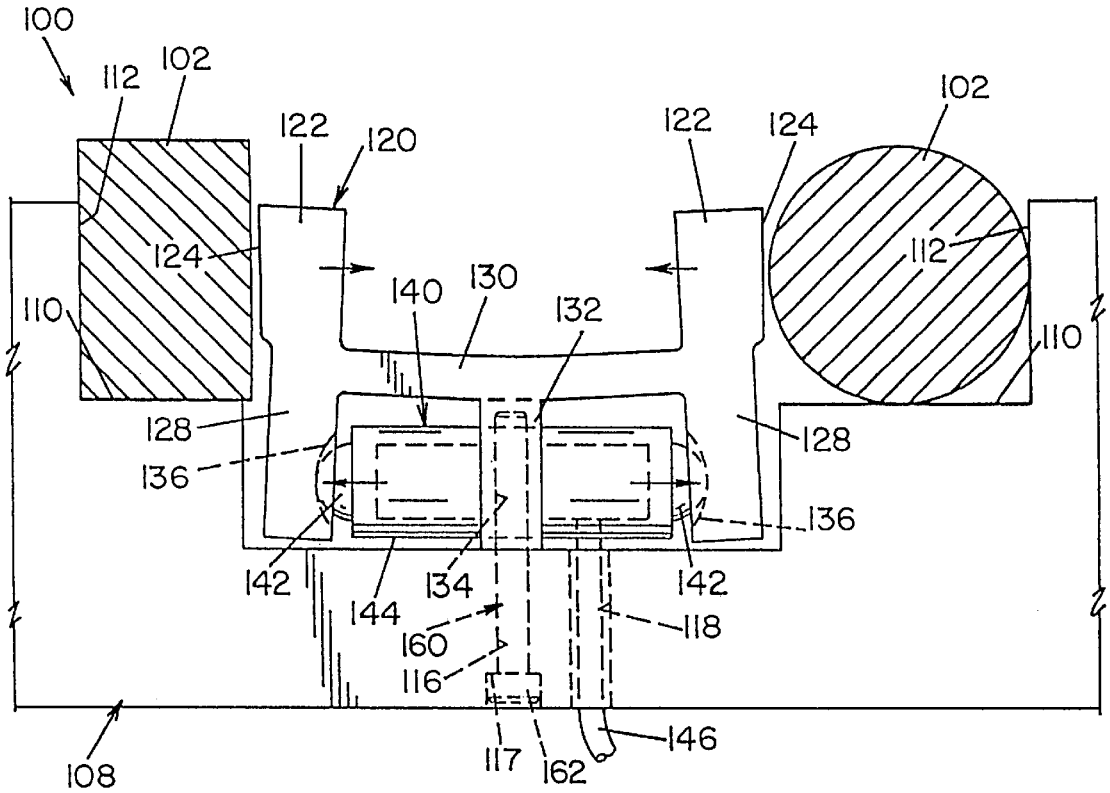
FIG. 4 is a plan view of the clamping device as in FIG. 2 which illustrates the clamping device in an unclamped position.
Figure 5:
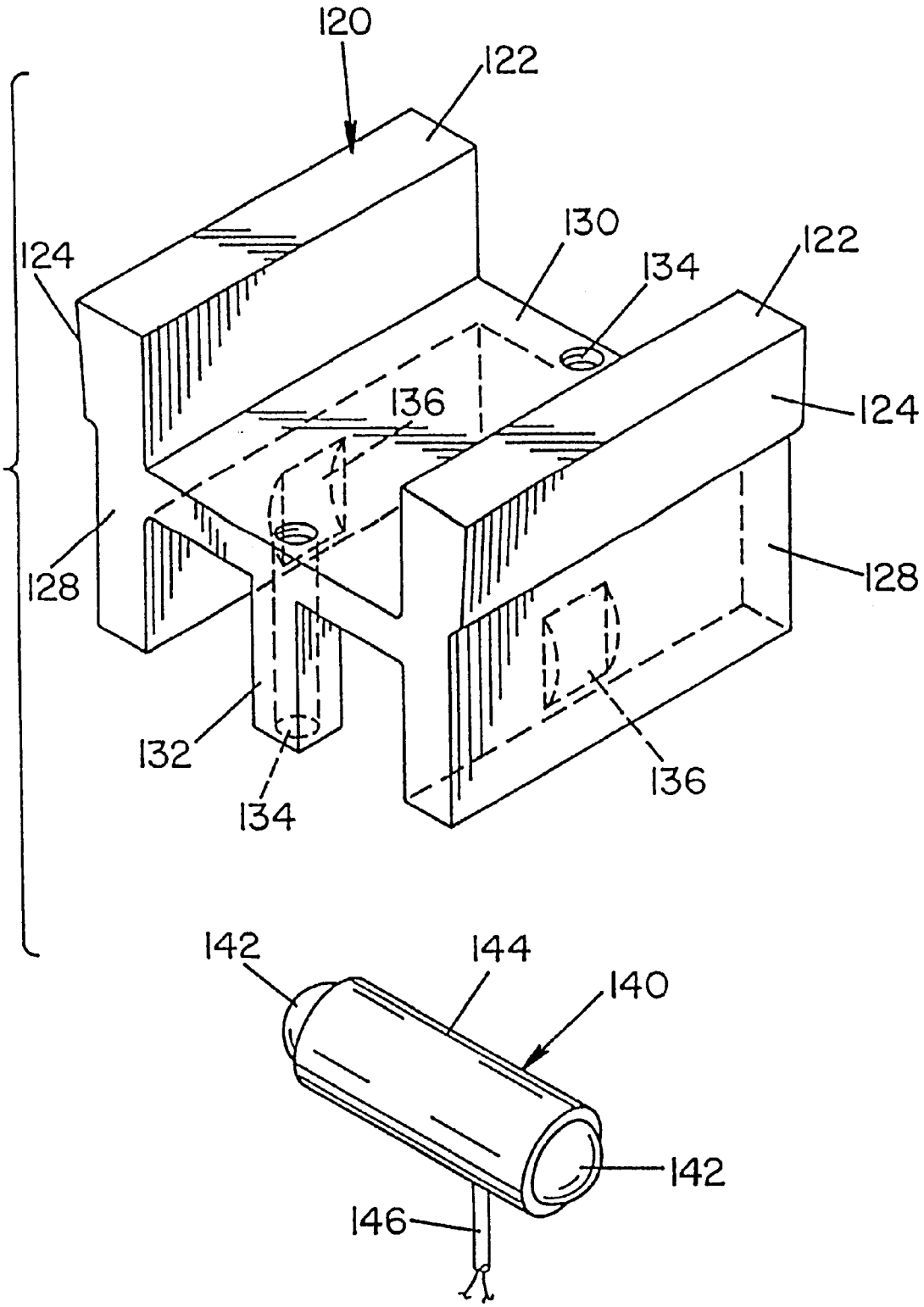
FIG. 5 is a pictorial view of two components of the clamp illustrated in FIG. 2.

The exemplatory embodiments of clamping devices of the present invention which are illustrated in FIGS. 2–29 are all related to positive clamping arrangements. However, it is understood that one skilled in the art can just as easily design a non-positive clamping device which incorporates the concepts set forth in this invention. Referring specifically to FIG. 2, a positive clamping device 100 is illustrated. A workpiece 102 is clamped between clamp body 108 and clamping element 120. As can be appreciated, many workpiece configurations can be clamped by clamping device 100. For illustrative purposes, two shaped workpieces are illustrated, one workpiece having a circular cross-section and another workpiece having a rectangular cross-section. Both workpieces are positioned against clamp base surface 110 and clamp side surface 112 of clamp body 108. The clamp body includes a clamp element cavity 114 which is designed to receive a portion of clamping element 120. In the base of clamp element cavity 114 is a fastener cavity 116 adapted to receive a bolt 160 which secures clamp element 120 to clamp body 108. Clamp element 120 includes two clamp legs 128 connected together by a clamp arm 130. On the top side of each clamp leg is a clamp head 122 which includes a clamp surface 124. Clamp surface 124 is adapted to contact workpiece 102 and to rigidly secure workpiece 102 on clamp body 108. The clamp surface may include a rough surface to improve the grip of the clamp surface to the workpiece during clamping. Each clamp leg also includes a clamp slot 136 located at the lower inner surface of the clamp leg. The clamp slot is adapted to receive an expander head 142 of expander 140. Connected to the clamp arm 130 and between the two clamp legs 128 are two clamp fingers 132. Clamp fingers 132 include a finger opening 134 adapted to receive the end of bolt 160 so that the clamp element 120 can be securely attached to the clamp body 108. As best illustrated in FIG. 4, bolt 160 is inserted into the base of clamp body 108 through fastener cavity 116 and into finger opening 134. Preferably, finger opening 134 includes a threaded surface so the end of bolt 160 can be threaded into finger opening 134. Bolt 160 includes a bolt head 162 which engages fastener landing 117 to prevent bolt 160 from passing completely through fastener cavity 116 so that bolt 160 can properly secure clamp element 120 to clamp body 108 when bolt 160 is threaded into finger opening 134. Expander 140 which is positioned between the two clamp legs 128 and secured in clamp slot 136 is also preferably positioned between the two clamp fingers 132 connected to clamp arm 130. Expander 140 includes a heat jacket 144 and an electric cable 146 which is connected to the heat jacket. The electric cable provides an electric current from power source 150 to heat jacket 144 which in turn transfers heat to the expander material inside heat jacket 144. Clamp body 108 includes a cable passage 118 to allow cable 146 to pass through the clamp body and connect to heatjacket 144. Preferably, the expandable material of the expander is a shape memory alloy composed primarily of nickel and titanium.

As illustrated in FIG. 2, clamp 100 is a positive clamp arrangement. Clamp element 120 is originally shaped so as to naturally apply a clamping force to workpiece 102 as illustrated by the clamping force arrows in FIG. 2. The release of the workpiece from clamping device 100 is illustrated in FIG. 4. Power source 150 is activated which supplies an electric current through electric cable 146 to heat jacket 144 of expander 140. Heat jacket 144 rises in temperature causing the expander material of the expander to increase in volume thereby causing expander ends 142 to apply a force to clamp legs 128 as illustrated by the force arrows in FIG. 4. Expander 140 causes clamp legs 128 to move apart which results in the clamp heads moving toward one another thereby moving the clamp surface 124 of clamp head 122 away from workpiece 102. This allows the workpiece 102 to be removed from clamp device 100. A new workpiece can then be inserted into clamp device 100 by placing the workpiece on clamp base surface 110 and against clamp side 112. Once the workpiece is properly positioned on clamp body 108, power source 150 is deactivated which allows heatjacket 144 to begin cooling off. The cooling off of heat jacket 144 results in the expander material to return to its original shape and volume. The return of the expander to its original shape allows the clamping element 120, which is preferably made up of a super elastic alloy primarily of titanium and nickel, to return to its natural clamped state.

Figure 6:
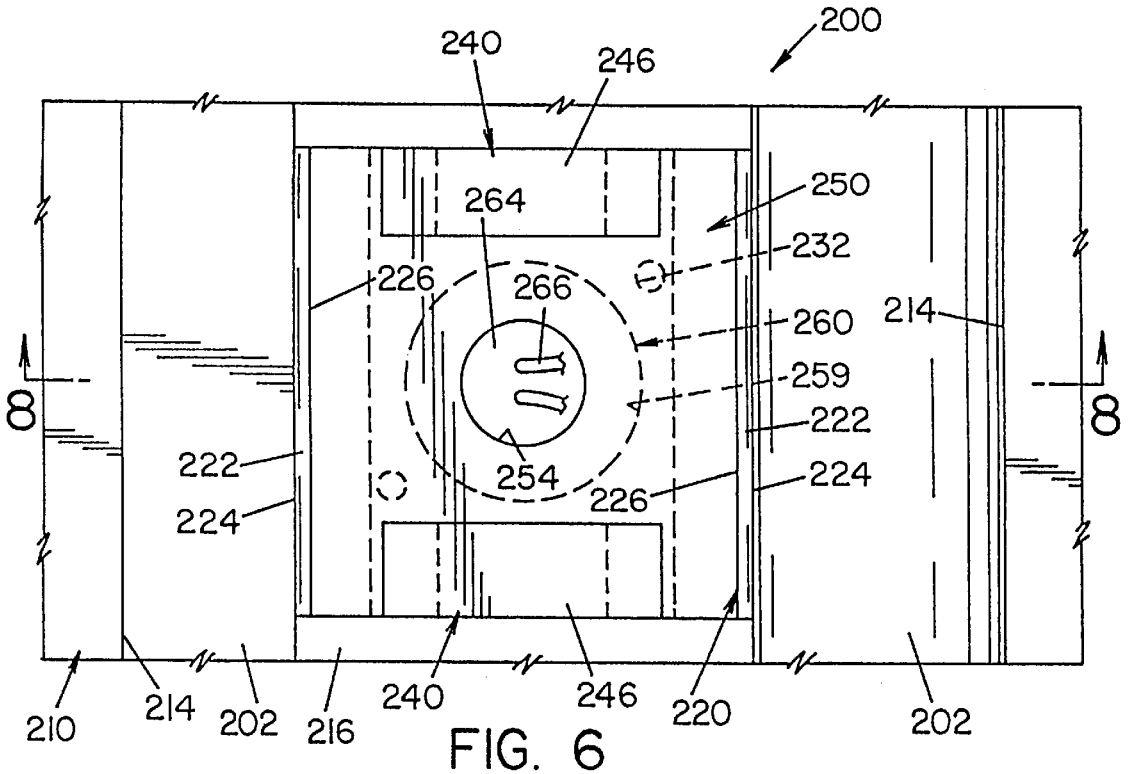
FIG. 6 is a top view of a second embodiment of a clamp in accordance with the present invention.
Figure 7:
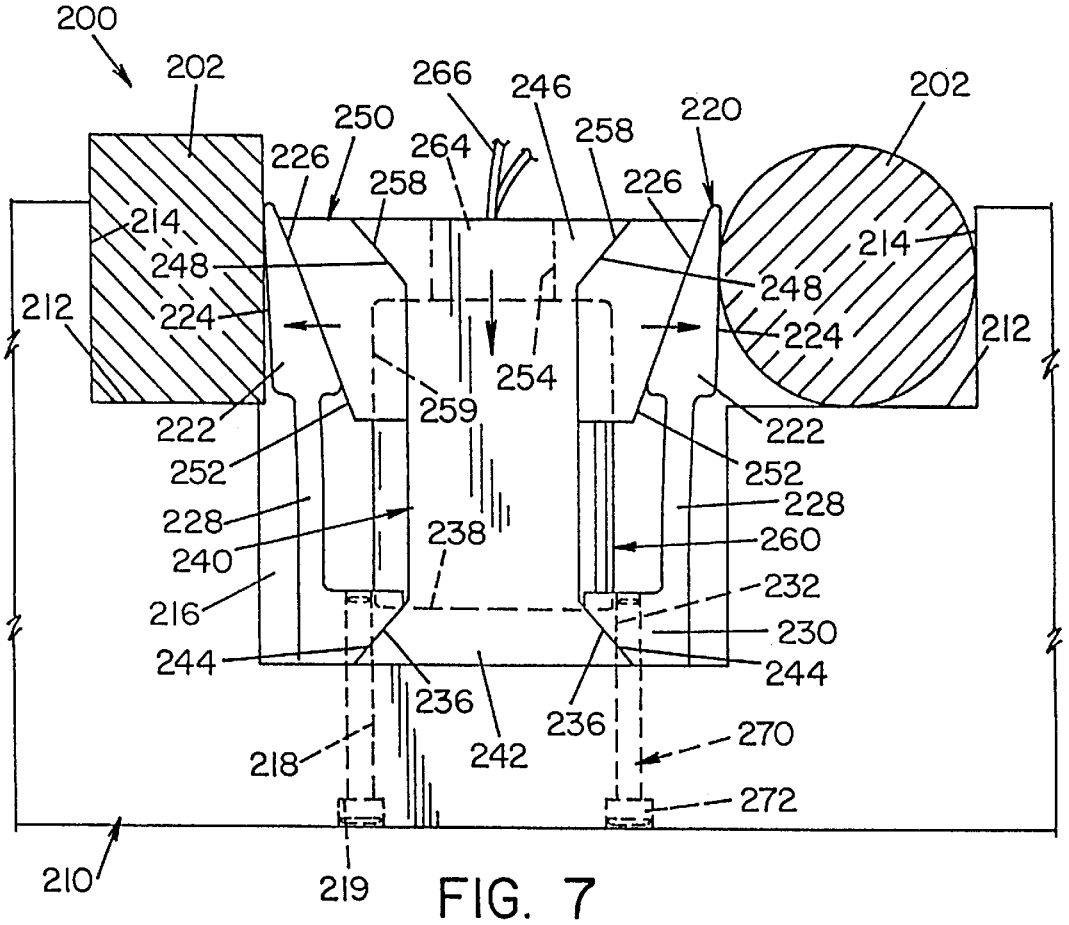
FIG. 7 is a side view of the clamp as illustrated in FIG. 6.
Figure 8:
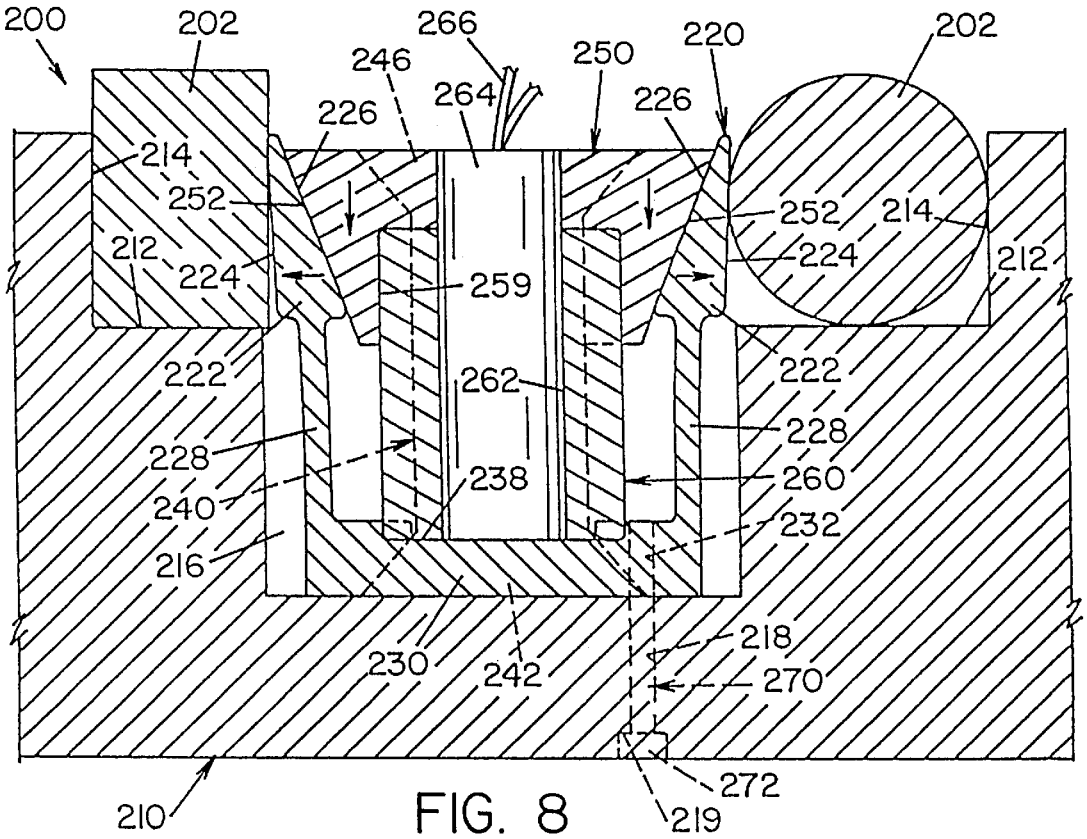
FIG. 8 is a cross-sectional view taken along line 8:8 in FIG. 6 which illustrates the clamp in a clamped position.
Figure 9:
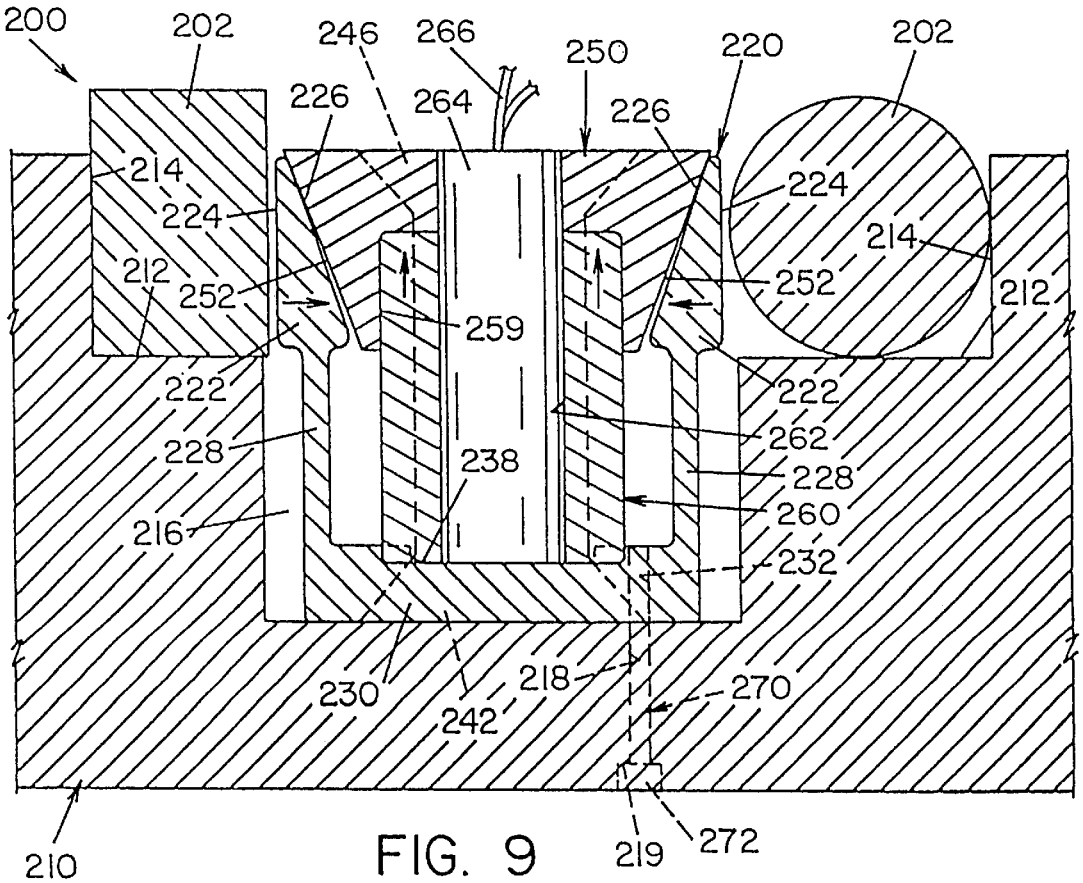
FIG. 9 is a similar view as shown in FIG. 8 but which illustrates the clamping device in an unclamped position.
Figure 10:
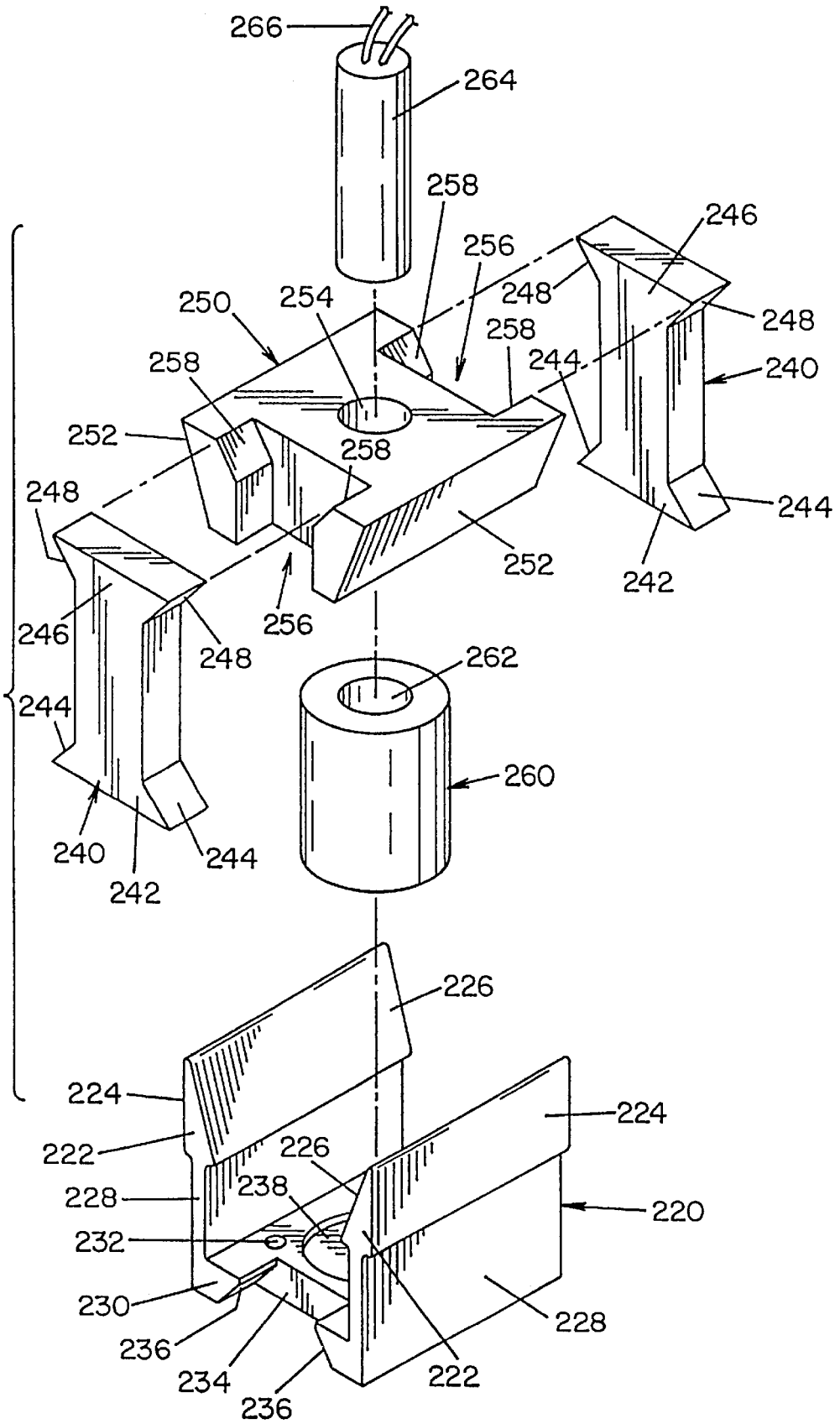
FIG. 10 is a pictorial view of several elements of the clamp as shown in FIG. 6.
Figure 11:
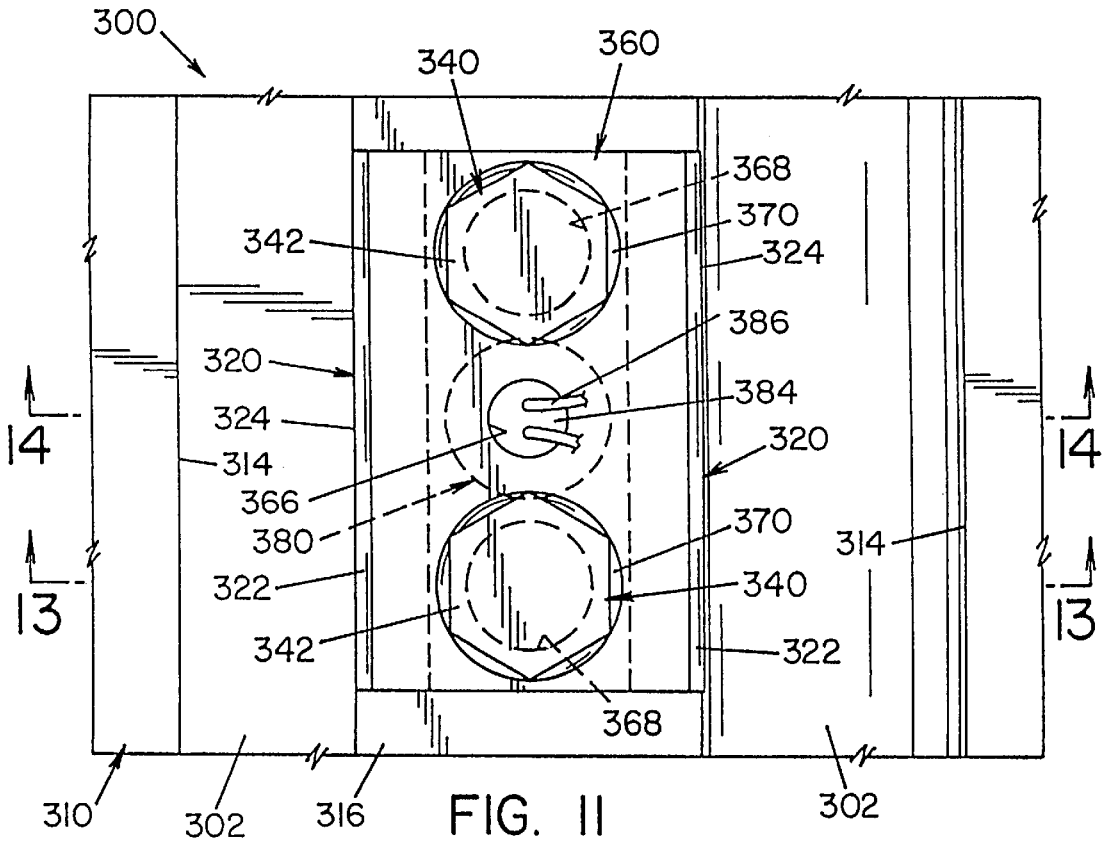
FIG. 11 is a top view of another embodiment of a clamp in accordance with the present invention.

FIGS. 6–10 illustrate another design for a positive clamping device. Referring now to FIGS. 6, 7 and 10, clamp device 200 clamps a workpiece 202 onto clamp body 210 between clamp base surface 212, clamp side surface 214 and clamp surface 224. Clamp body 210 includes a clamp element cavity 216 wherein a clamp element 220 is rigidly secured to the clamp body by a bolt 270. Clamp element 220 includes two legs connected at the two ends of clamp base 230. Clamp base 230 includes at least one clamp opening 232 which allows bolt 270, which is passed through fastener cavity 218, to be threaded into the clamp opening 232 to secure clamp element 220 to the base of clamp element cavity 216. Bolt 270 includes a bolt head 272 which engages fastener landing 219 of fastener cavity 218 so as to prevent bolt 270 from freely passing through fastener cavity 218 when clamping element 220 is secured to clamp body 210. At the top ends of each clamp leg 228 is a clamp head 222. The clamp head includes a clamp surface 224 adapted to engage workpiece 202 and a wedging surface 226 adapted to engage wedge face 252. The wedging surface 226 is a sloped surface that slopes away from side surface 214. The upper side of clamp base 230 includes an expander cavity 238 adapted to receive the base of expander 260. The two sides of clamp base 230 each include a compressor slot 234 having two slot landings 236. The two slot landings 236 are spaced apart and are sloped so as to slope toward one another. Compressor slot 234 is adapted to receive the compressor base 242 of compressor 240. Compressor base 242 includes two base legs 244 shaped to engage the two slot landings 236 in compressor slot 234. Preferably, the slope surfaces of base legs 244 are complementary to the slope surfaces of slot landings 236. As illustrated in FIG. 7, clamp wedge 250 is inserted onto the top side of expander 260. Preferably, clamp wedge 250 includes an expander cavity 259 to receive the top part of expander 260. The two sides of clamp wedge 250 include a compressor opening 256. Each compressor opening 256 includes two sloped opening landings 258. The compressor openings 256 are adapted to receive the compressor head 246 of compressor 240. Compressor head 246 includes two slope head legs 248 which are adapted to engage opening landings 258 of the compressor opening 256 of clamp wedge 250. The head legs 248 are sloped so as to be complementary to the slope surfaces of opening landings 258. Clamp wedge 250 includes a wedge hole 254 to allow heat core 264 to be inserted through clamp wedge 250 into expander opening 262 of expander 260. Heat core 264 includes an electric cable 266 which is connected to a power source.

Expander 260 is a shape memory alloy preferably made up of a majority of nickel and titanium. Clamping element 220 is a super elastic alloy which is shaped to be in an unclamped position in its natural state. Compressor 240 is also preferably a super elastic alloy. The super elastic alloy for both the compressor and clamping element is preferably a nickel-titanium based alloy. Referring now to FIGS. 7 and 8, when the clamping element, compressor, clamp wedge and expander are connected together, compressor 240 causes clamp wedge 250 to be drawn toward the base of clamping element 220. The movement of clamp wedge 250 toward the base of clamping element 220 in turn causes clamp heads 222 of clamping element 220 to move toward workpiece 202 thereby clamping workpiece 202 onto clamp body 210 as shown by the arrows in FIGS. 7 and 8. When the workpiece is to be removed from clamp device 200, a current is supplied through electric cable 266 to heat core 264 causing the heat core to increase in temperature. The increase in temperature of the heat core in turn causes expander 260 to expand in volume as shown in FIG. 9. The expansion of expander 260 causes a force to be applied to the underside of clamp wedge 250 causing the clamp wedge to move away from clamp base 230. The upward movement of clamp wedge 250 causes compressors 240 to expand in length. Furthermore, the upward movement of clamp wedge 250 allows clamp heads 222 to move into their natural unclamped state thereby moving clamp surfaces 224 from workpiece 202 thereby allowing the workpiece to be removed from clamp device. Once the workpiece is removed, a new workpiece can be repositioned onto the clamp body. Once the workpiece is properly positioned on the clamp body, the current to the heat core is terminated thereby allowing heat core 264 to cool. The cooling of heat core 264 results in expander 260 to return to its original shape and volume which in turn results in compressor 240 to also return to its original shape thereby forcing clamp wedge 250 downwardly toward clamp base 230. The downward movement of clamp wedge 250 in turn causes clamp heads 222 to move toward workpiece 202 causing clamp surfaces 224 to engage and clamp workpiece 202 onto clamp body 210.

Referring now to FIGS. 11–18, there is illustrated another clamping device 300 which clamps aworkpiece 302 to clamp body 310 at clamp base surface 312 and clamp side surface 314. Clamp body 310 includes a clamp element cavity 316 adapted to receive clamp base 330 of clamping element 320. Clamp base 330 includes two clamp openings 332 which are positioned to be aligned with the two fastener cavities 318 in the base of clamp element cavity 316. Positioned between the two clamp openings 332 is preferably an expansion cavity adapted to receive the base of expander 380. Although this expander compressor cavity is not specifically illustrated in FIGS. 11–18, such an expander cavity would be similar in design to the expander cavity disclosed in FIGS. 7 and 10. Connected to each end of clamp base 330 is a clamp leg 328. The top of each clamp leg 328 includes a clamp head 322 which has a clamp surface 324 facing workpiece 302 and a wedging surface 326 on the opposite side of clamp head 322. Both wedging surfaces 362 slope downwardly and toward one another. Wedging surfaces 326 are adapted to contact wedge face 326 of clamp wedge 360. Wedge faces 362 are slop surfaces which preferably have a complementary surface to the wedging surface 326 of clamping element 320. Clamp wedge 360 includes two which are in longitudinal alignment with the two clamp openings 322 and two fastener cavities 318. Compressor opening 368 is adapted to allow the end of compressor 340 to pass through clamp wedge 360. Compressor 340 includes a compressor head 342 which includes a wedge engagement surface 350. The wedge engagement surface is a sloped surface designed to engage the sloped surface of opening landing 370 of compressor opening 368. Compressor head 342 is sized larger than the body of compressor 340 so as not to be able to pass through compressor opening 368. The end of compressor 340 includes a threaded end 346 designed to pass through compressor opening 368 of clamping wedge 360 and clamp opening 332 of clamping element 320 and to engage the threaded surfaces of fastener cavity 318. Clamp wedge 360 also includes an expander cavity 366 adapted to allow a heat core 384 to pass through the expander cavity and into the expander opening 382 of expander 380. Heat core 384 has an electric cable 386 attached thereto.

Figure 12:
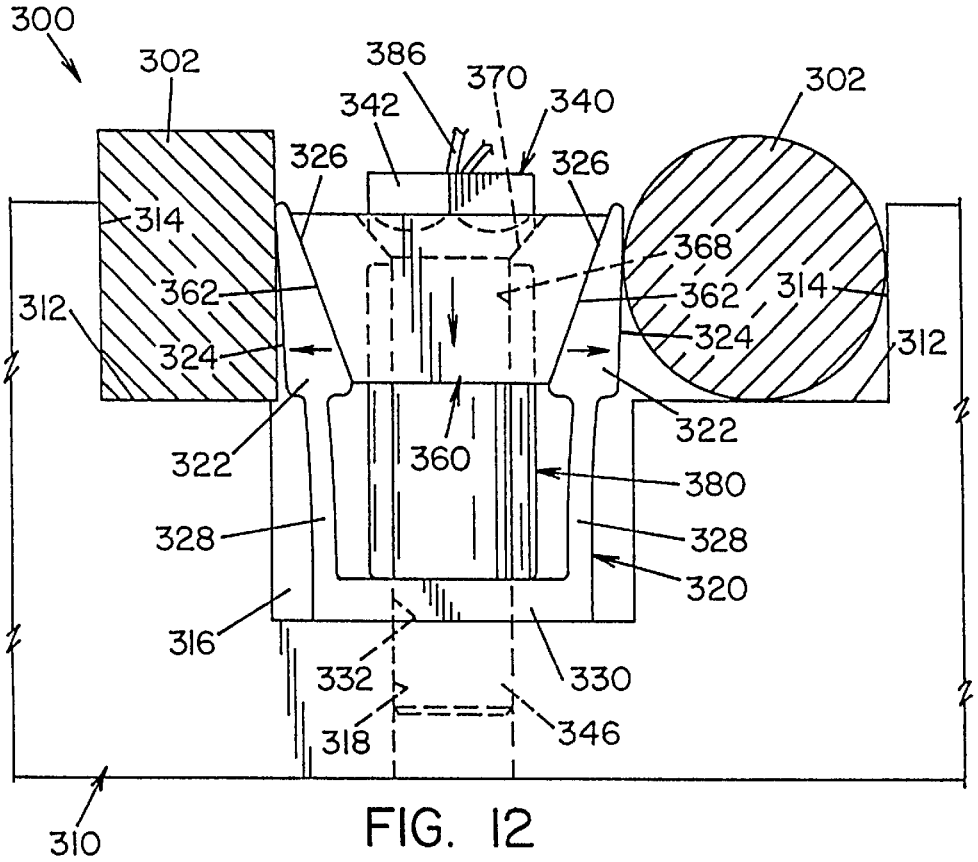
FIG. 12 is a side view of the clamp illustrated in FIG. 11.
Figure 13:
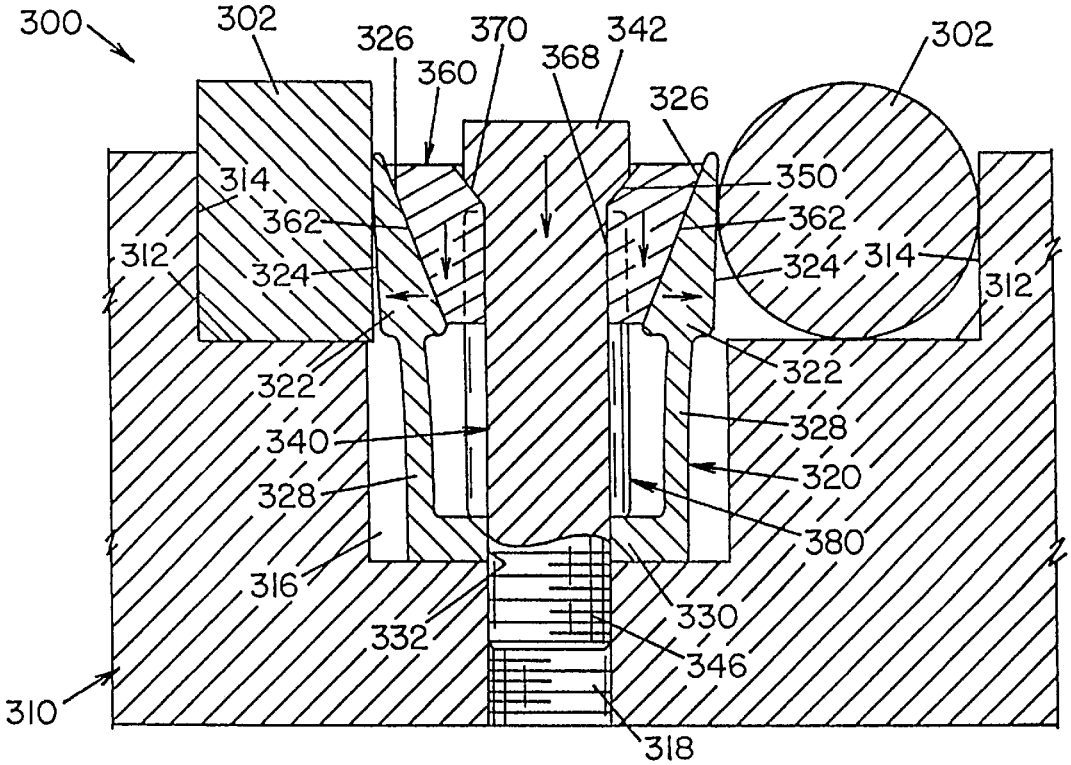
FIG. 13 is a cross-sectional view taken along line 13:13 in FIG. 11 which illustrates the clamp in a clamped position.
Figure 14:
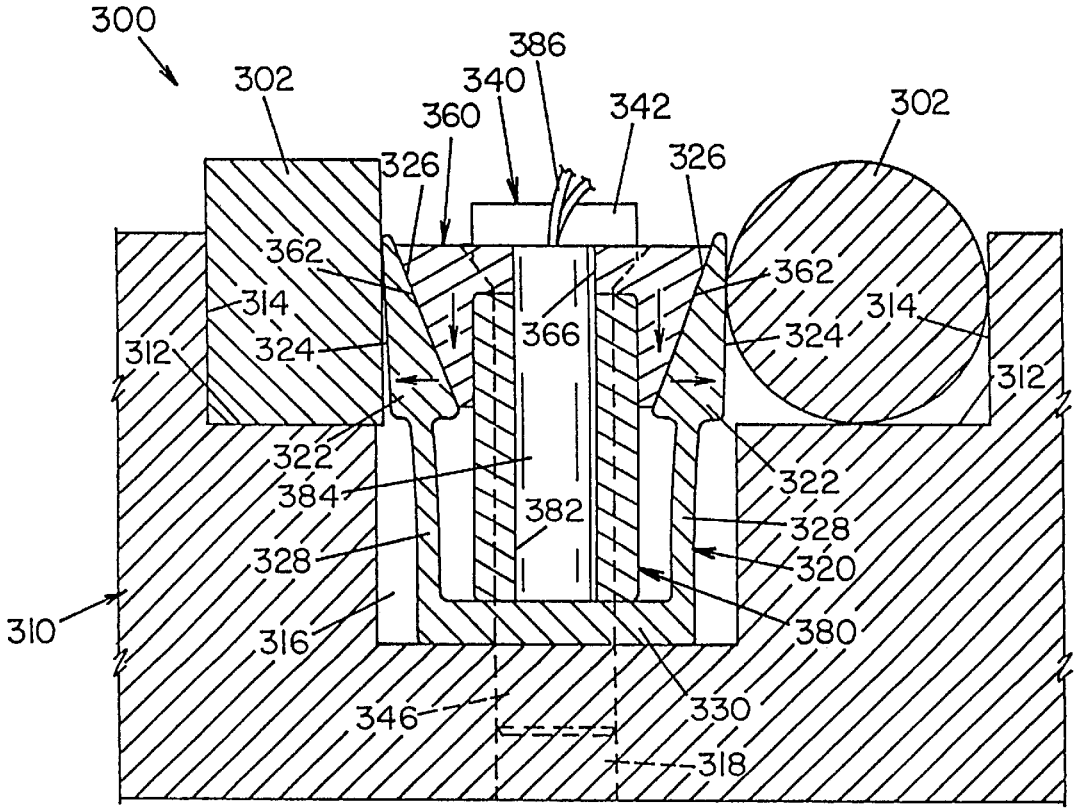
FIG. 14 is a cross-sectional view taken along line 14:14 of FIG. 11 which illustrates the clamp in a clamped position.
Figure 15:
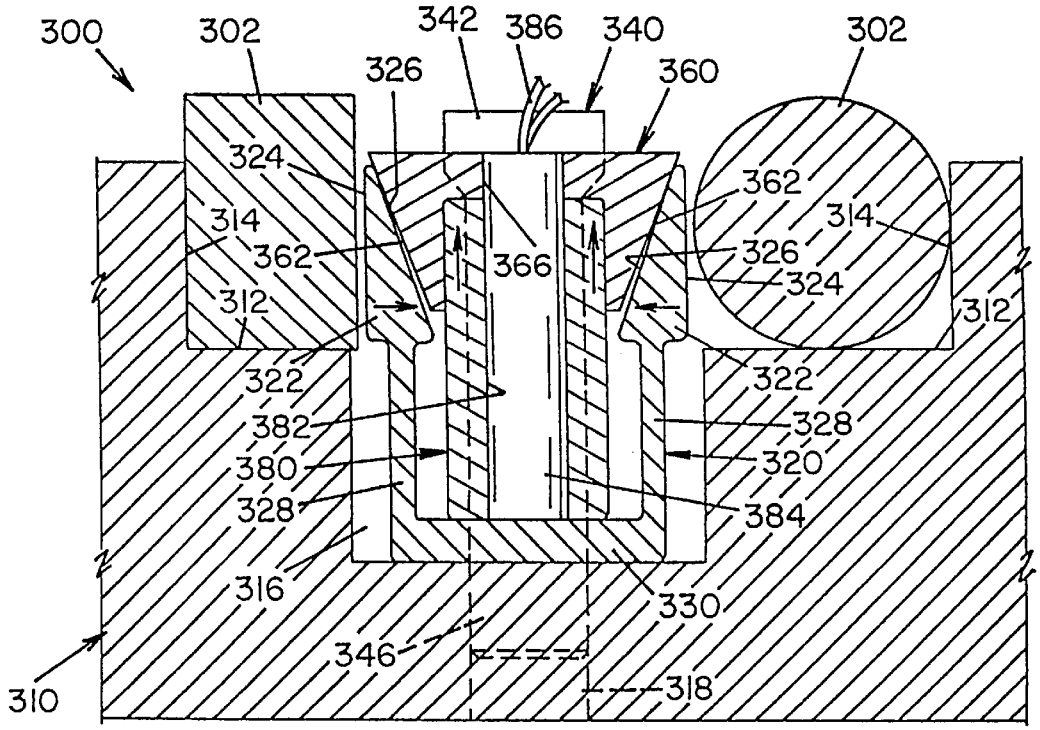
FIG. 15 is a similar view as shown in FIG. 14 but which illustrates the clamp in an unclamped position.

In operation, compressor 340 is secured into fastener cavity 318 so as to force clamp wedge 360 toward clamp base 330 thereby resulting in wedge face 362 to engage wedging surfaces 326 of clamp head 322 thereby causing clamp surface 324 to engage with and clamp workpiece 302 onto clamp body 310 as shown in FIGS. 12–14. Preferably, clamping element 320 is shaped to be naturally oriented in an unclamped position and is made of a super elastic alloy. In addition, compressor 340 is also preferably made up of a super elastic alloy. Both the clamping element and compressor are preferably made up of an alloy including nickel and titanium. Expander 380 is preferably made up of a shape memory alloy. Preferably, the shape memory alloy is primarily a nickel-titanium alloy. The clamping force caused by compressor 340 forces clamp wedge 360 downwardly which results in clamp surfaces 324 to engage with workpiece 302. When a workpiece is to be removed from clamp body 310, an electric current is supplied through electric cable 386 to heat core 386 to heat the heat core. The heating of the heat core results in expander 380 to expand in size as illustrated in FIG. 15. Expansion of expander 380 causes clamp wedge 360 to move upwardly and away from the base of the clamp base 330 of clamping element 320. The upward movement of clamp wedge 360 allows clamping element 320 to move in its natural unclamped position thereby allowing clamp surfaces 324 to move away from workpiece 302. Such movement of clamp surfaces 324 allows workpiece 302 to be removed from clamp body 310. A new workpiece can be inserted onto the clamp body to be clamped. Once the workpiece is properly positioned onto clamp base surface 312 and clamp side surface 314, the current supplied to heat core 384 is terminated thereby allowing expander 380 to return to its natural shape and size. Once expander 380 begins to contract in size, compressors 340 also begin to return to their natural shape due to their super elastic characteristics thereby causing clamp wedge 360 to move toward clamp base 330. This movement of clamp wedge 360 causes clamp surface 324 to once again toward workpiece 302 thereby clamping the workpiece onto clamp body 310.

Figure 17:
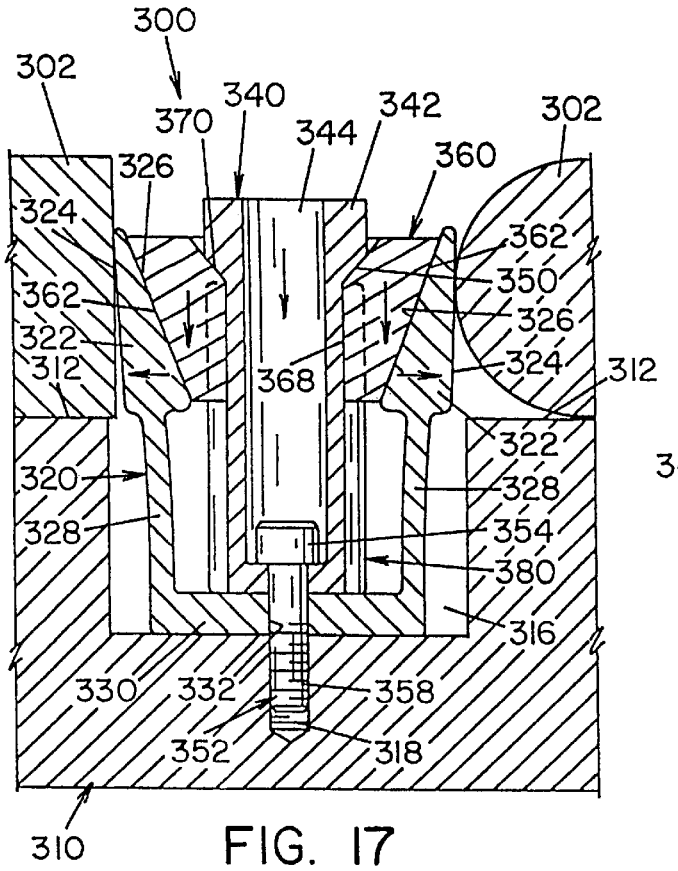
FIG. 17 is a view similar to FIG. 13 but illustrates still another embodiment of the present invention.
Figure 18:
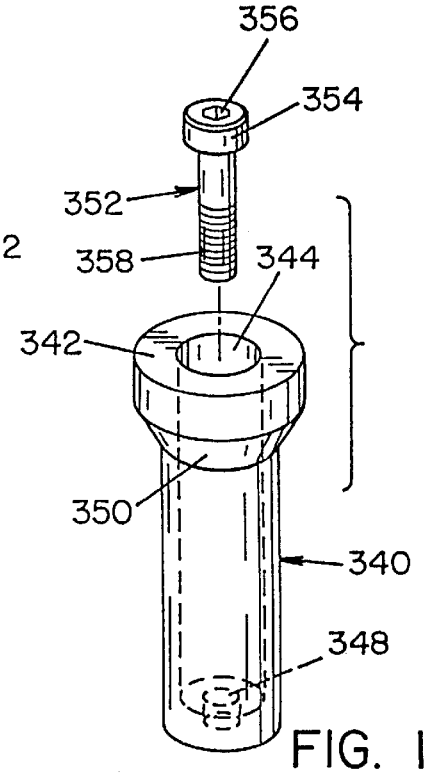
FIG. 18 is a pictorial view of two elements of the clamp illustrated in FIG. 17.
Figure 16:
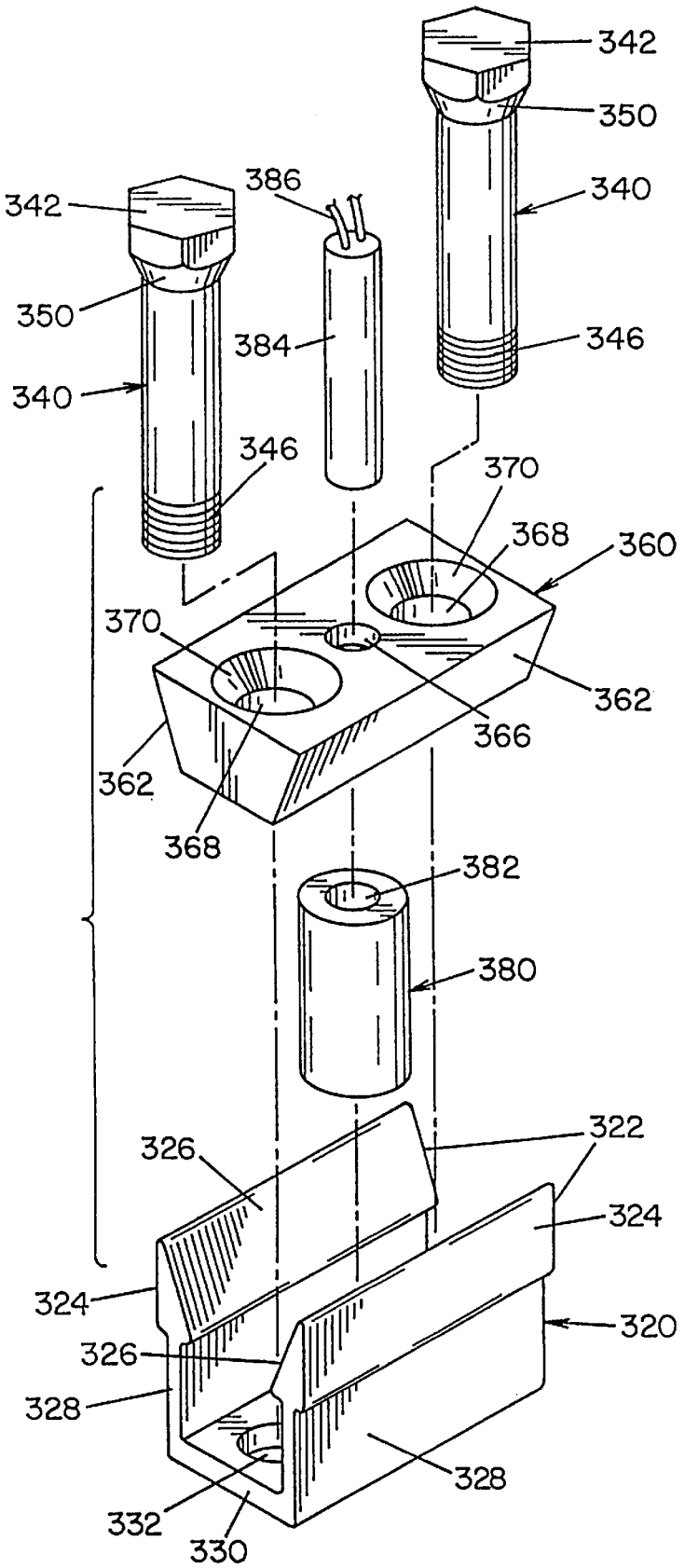
FIG. 16 is a pictorial view of several elements of the clamp as illustrated in FIG. 11.
Figure 19:
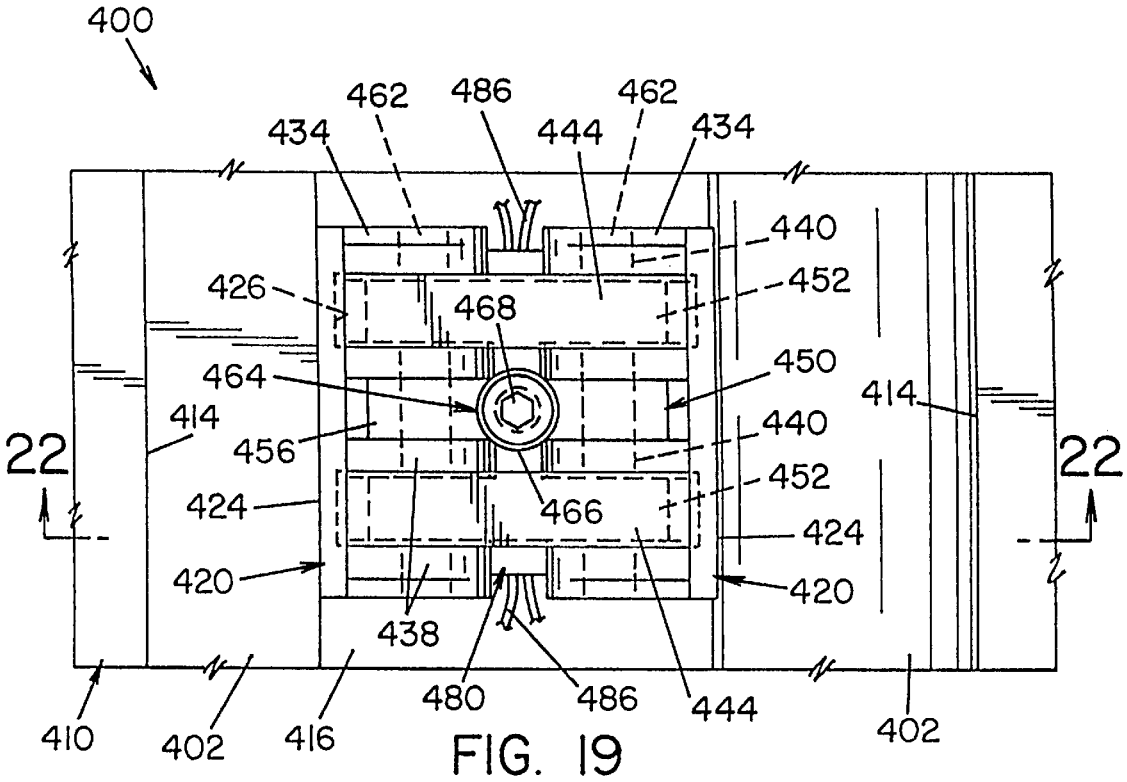
FIG. 19 is a top view of another embodiment of the clamp in accordance with the present invention.

FIGS. 17 and 18 illustrates an alternative design of compressor 340. The threaded end of compressor 340 is substituted for a compressor cavity 344 which allows a securing lug 352 to be inserted therein. At the base of compressor cavity 344 there is a small compressor passage which is designed to allow the end of securing lug 352 to be passed therethrough but is small enough to prevent the lug head 354 from passing through the compressor passageway 348. Securing lug 352 includes a threaded end 358 adapted to engage threaded surfaces of fastener cavity 318. Lug head 358 includes a head slot 356 to allow the securing lug to be rotated so that the securing lug can be threaded into fastener cavity 318 to secure compressor 340 into position. The base of compressor 340 rests upon the top of clamp base 330. Compressor passage 348 is in longitudinal alignment with clamp opening 332 and fastener cavity 318 so as to allow the end of securing lug 352 to pass through compressor passageway 348 and clamp opening 332 so as to engage fastener cavity 318. The securing lug is designed to secure both the compressor and clamping element to clamp body 318.

Another alternate embodiment of a clamping device is illustrated in FIGS. 19–25. Referring now to FIGS. 19, 21 22, 23 and 25, there is disclosed a positive clamping device 400 designed to clamp aworkpiece 402 onto clamp body 410. Clamp body 410 includes a clamp base surface 412 and a clamp side surface 414 adapted to receive workpiece 402. Clamp body 410 also includes a clamp element cavity 416 adapted to receive a clamp mount 450 and a clamping element 420 rotatably mounted onto clamp mount 450. The size of clamp element cavity 416 is selected to allow for a limited rotation of clamping element 420 on clamped element 450. Clamp mount 450 includes a clamp mount leg 456 and two mount brackets 452 attached to the upper portion of both sides of clamp mount leg 456. The height of clamp mount leg 456 is selected to be longer than the height of the two mount brackets 452 such that the mount brackets 452 do not contact the base of clamp element cavity 416 when secured to clamp body 410. Clamp mount leg 456 includes a mount fastener cavity 460 extending through the mount leg to allow the end of a securing lug 464 to pass through mount leg 456 and engage fastener cavity 418 to the base of clamp element cavity 416 so as to secure clamp mount 450 to clamp body 410. Securing lug 464 includes a threaded end 470 adapted to be threaded into the threaded surfaces of fastener cavity 418. Securing lug 464 also includes a lug head 466 which has a larger diameter than the body of the securing lug so as not to allow the lug head to pass through fastener cavity 460 of clamp mount 450. A head slot 468 is positioned on lug head 466 so that the securing lug can be threaded into fastener cavity 418. The two mount brackets on clamp mount 450 are spaced from the sides of mount fastener cavity 460. Positioned at each end of the mount brackets is a bracket opening 454. Bracket openings 454 pass through mount brackets 452 at an axis transverse to the longitudinal axis of the mounting brackets. Clamp mount leg 456 includes a leg opening 458 which is in longitudinal alignment with the mounting brackets that are mounted on both sides of the mount leg. Clamping element 420 includes a clamp face 432 and a clamp surface 424 positioned at the upper part of the clamp face. Clamp surface 424 is adapted to clamp workpiece 402 onto clamp body 410. Two clamp legs 434 are positioned on both sides of clamp surface 424. Each clamp leg includes a leg opening 436. On the backside of clamp element 420 there is mounted four clamp fingers 438 which are spaced apart at a substantially equal distance from one another. The clamp fingers include finger openings 440 which are alignment with and are approximately the same size as leg openings 436 on clamp legs 434.

Figure 21:
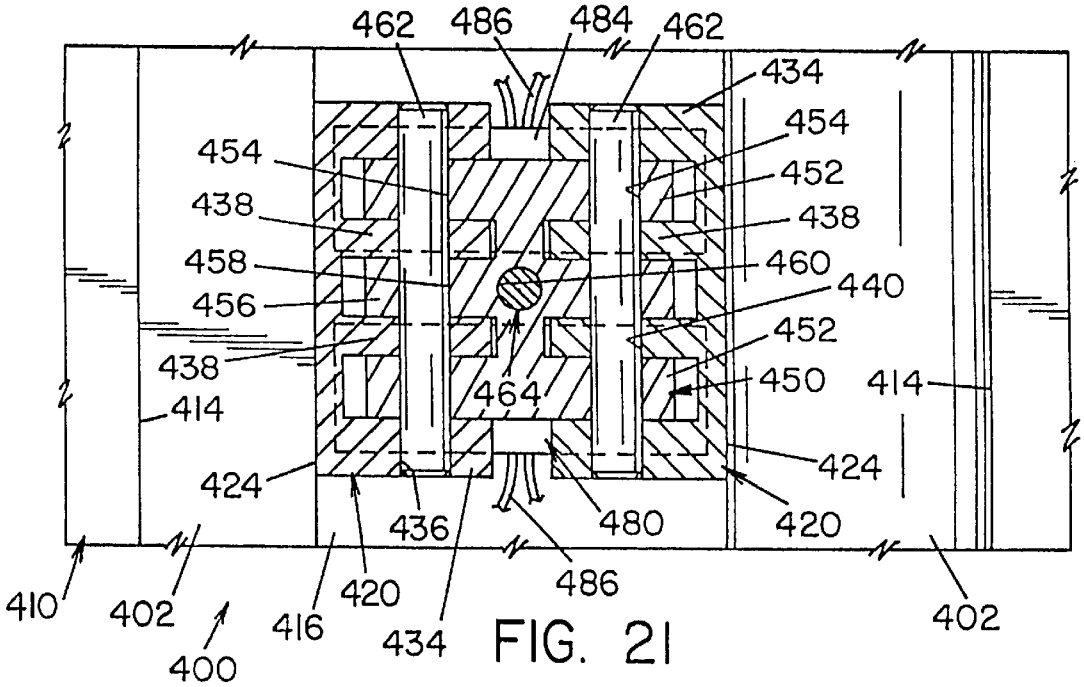
FIG. 21 is a cross-sectional view taken along line 21:21 of FIG. 20.
Figure 25:
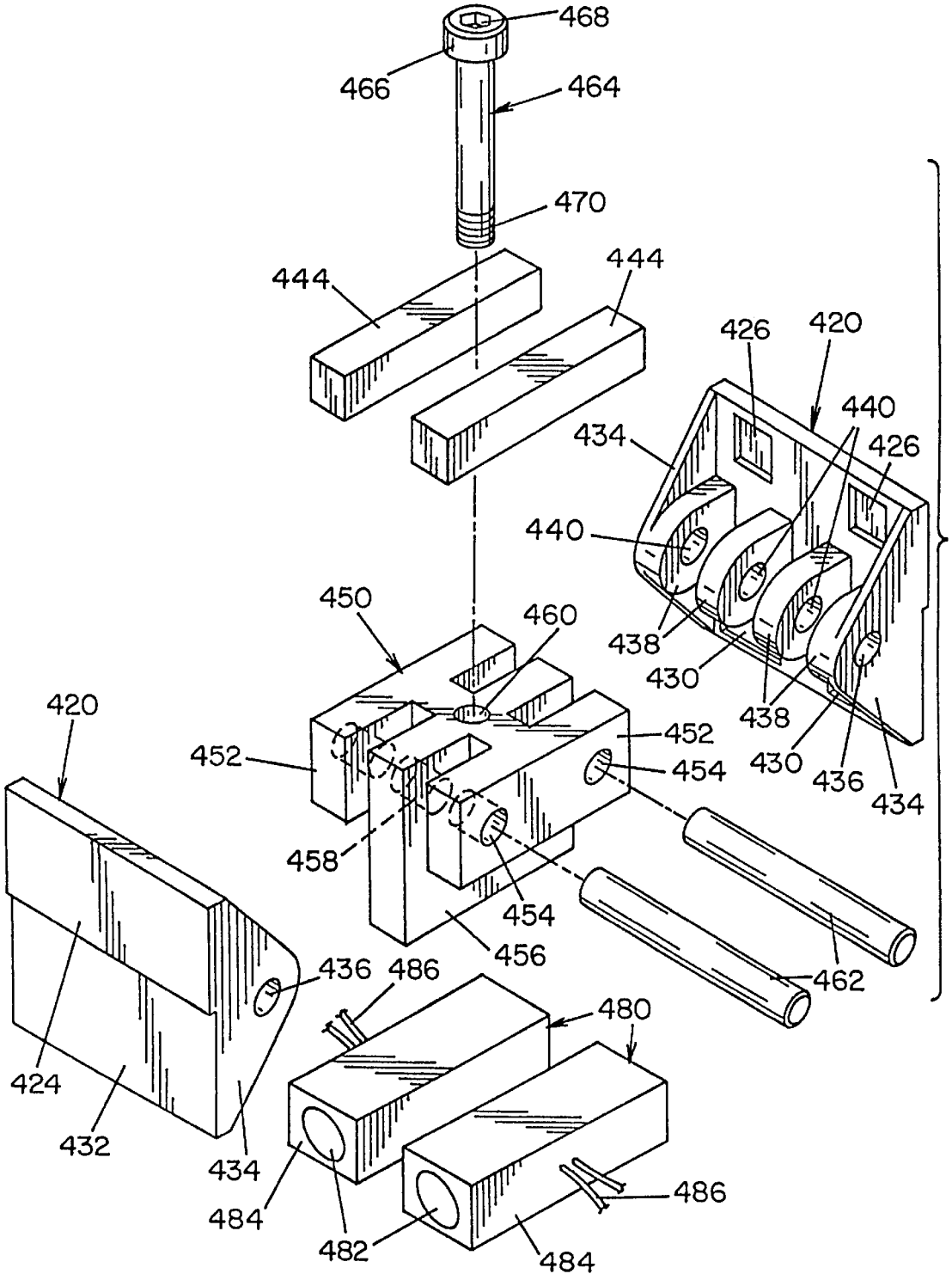
FIG. 25 is a pictorial view of several of the components of the clamp as illustrated in FIG. 19.
Figure 26:
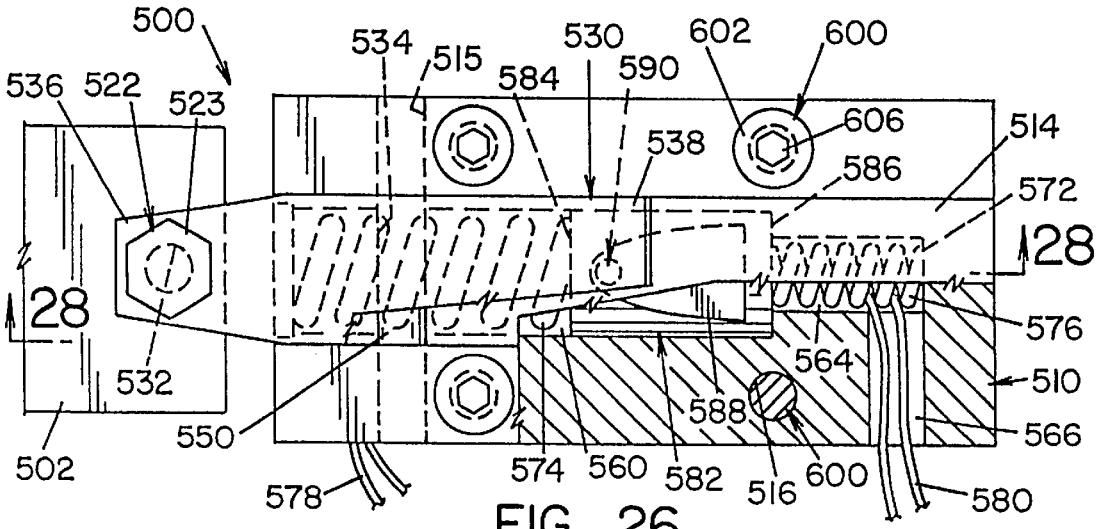
FIG. 26 is a top view of another clamp in accordance with the present invention.

As best illustrated in FIG. 25, four clamp fingers are connected to each clamp leg 434. Clamp element 420 is rotatably connected to clamp mount 450 by positioning the sides of the clamp fingers closely adjacent to the sides of mount brackets 452 and/or mount leg 456 until the opening in the fingers and the legs of clamping element 420 are in alignment with the openings in the mount brackets and mount leg of clamping element 450. Once all the openings are properly aligned, clamp pins 462 are inserted through the openings so as to rotatably secure clamping element 420 to clamp mount 450 as illustrated in FIG. 21.

Figure 22:
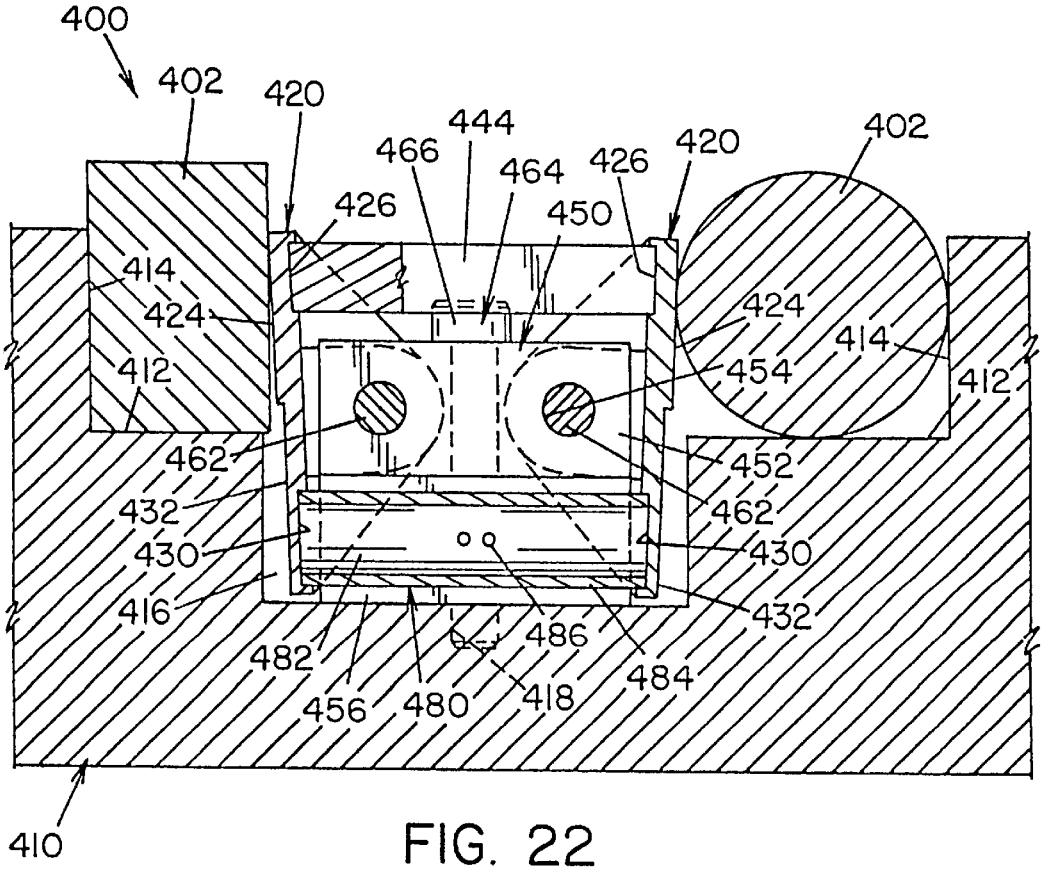
FIG. 22 is a cross-sectional view taken along line 22:22 of FIG. 19 which illustrates the clamp in a clamped position.
Figure 23:
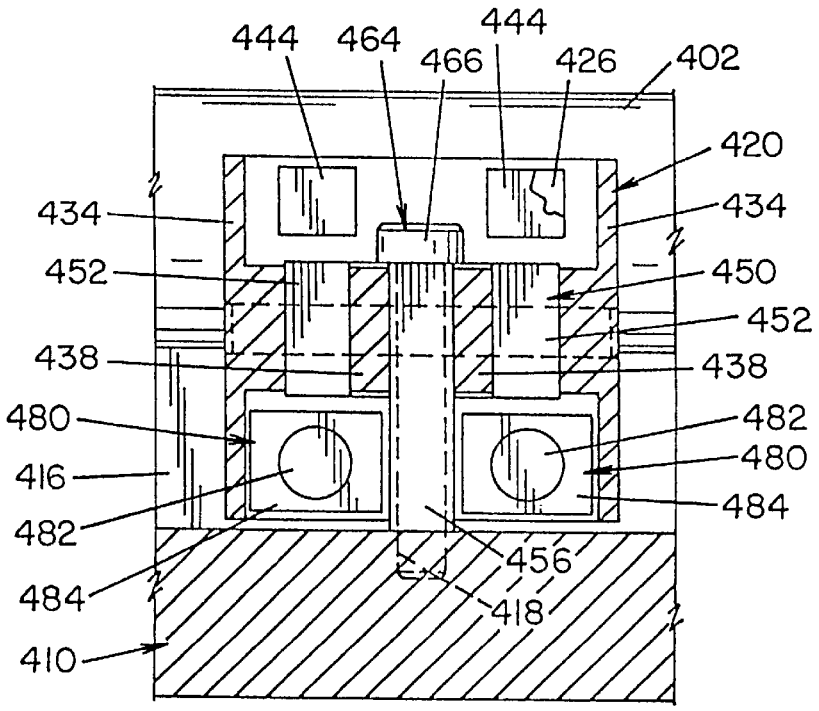
FIG. 23 is a cross-sectional view taken along line 23:23 of FIG. 20.
Figure 24:
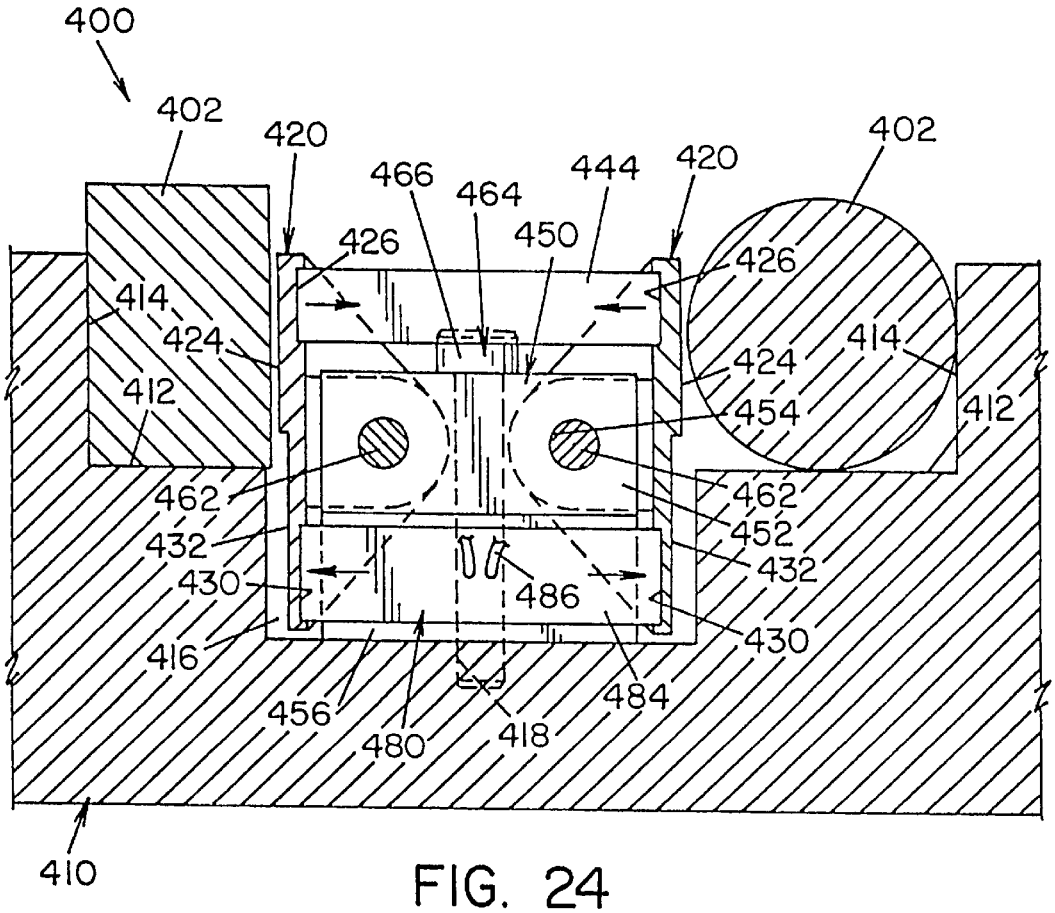
FIG. 24 is a similar view as shown in FIG. 22 but which illustrates the clamp in an unclamped position.

Referring now to FIGS. 22 and 25, clamping element 420 includes two compression slots 426 positioned at the upper inner side of the clamping element. These compression slots are adapted to receive the ends of compressor 444. Clamping element 420 also includes two expander slots 430 positioned at the lower back face of the clamping element. These expander slots are adapted to receive the ends of expander 480. Expander 480 includes an expandable material 482 which is surrounded by a heat jacket 484. An electric cable 486 is connected to heat jacket 484.

Figure 20:
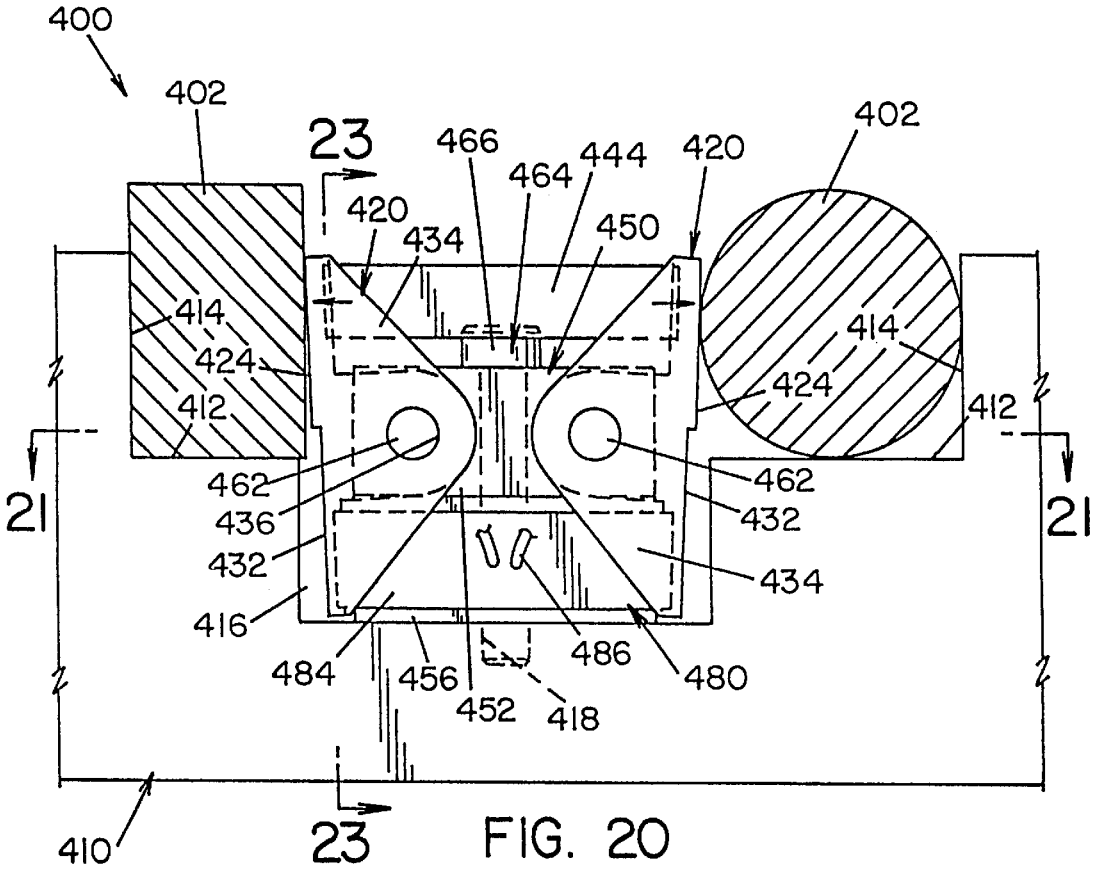
FIG. 20 is a side view of the clamp illustrated in FIG. 19.

Referring now to FIG. 20, when clamp device 400 is assembled, the clamp device is a positive clamping device. Compressor 444 which is made up of a super elastic alloy is sized so that when the two compressors are positioned in the compressor slots of the clamping element, the clamp face 432 is slightly rotated such that the clamp surface 424 engages workpiece 402 and clamps workpiece to clamp body 410. The super elastic alloy preferably includes titanium and nickel. When a workpiece is to be removed or replaced from the clamp body, a current is supplied through electric cable 486 to heat jacket 484 to heat the heat jacket. When the heat jacket is heated, the two expanders 480 which are made up of a shape memory alloy, expand in size thereby applying a force onto the bottom portion of the clamp leg. The shape memory alloy is primarily made of titanium and nickel. This expansive force causes the clamped element 420 to rotate on the clamp mount and compresses compressor 444 together thereby resulting in the clamp surface 424 moving away from workpiece 402. Once the clamp surface has moved a sufficient distance from the workpiece, the workpiece can be removed from the clamped body and a new workpiece can be repositioned in the clamp body. To cause a workpiece to once again be clamped to the clamp body, the current to the heat jacket is terminated thereby allowing the heat jacket to cool. When the heat jacket begins to cool, the expander retracts to its original shape and volume thereby allowing the compressors to move to their original natural position which in turn causes the clamping element to rotate on the clamp mount so that the clamp surface engages workpiece 402 to clamp the workpiece to clamp body 410.

Figure 27:
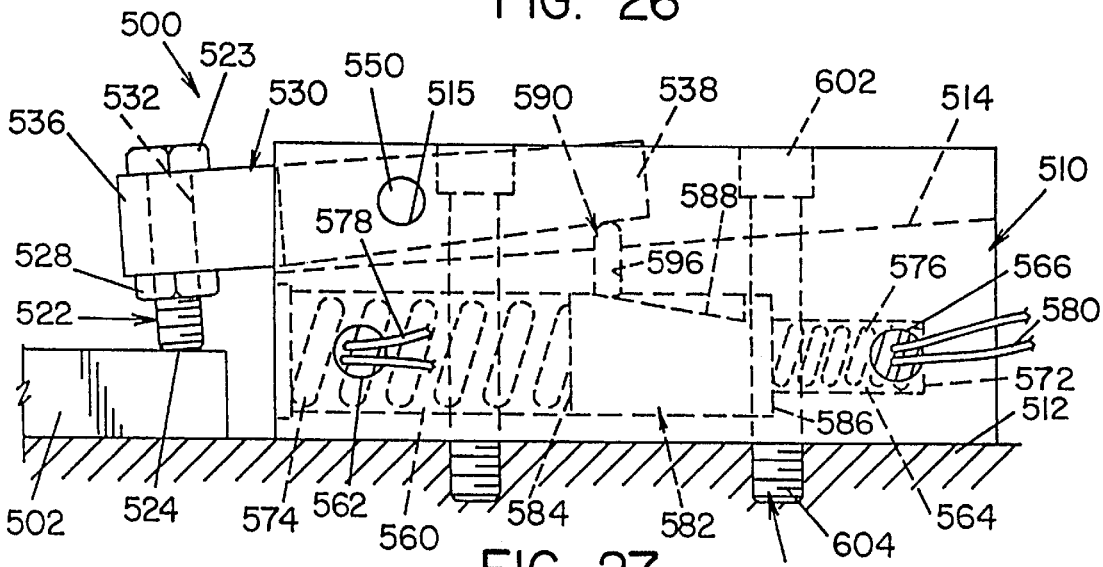
FIG. 27 is a side view of the clamp illustrated in FIG. 26.
Figure 28:
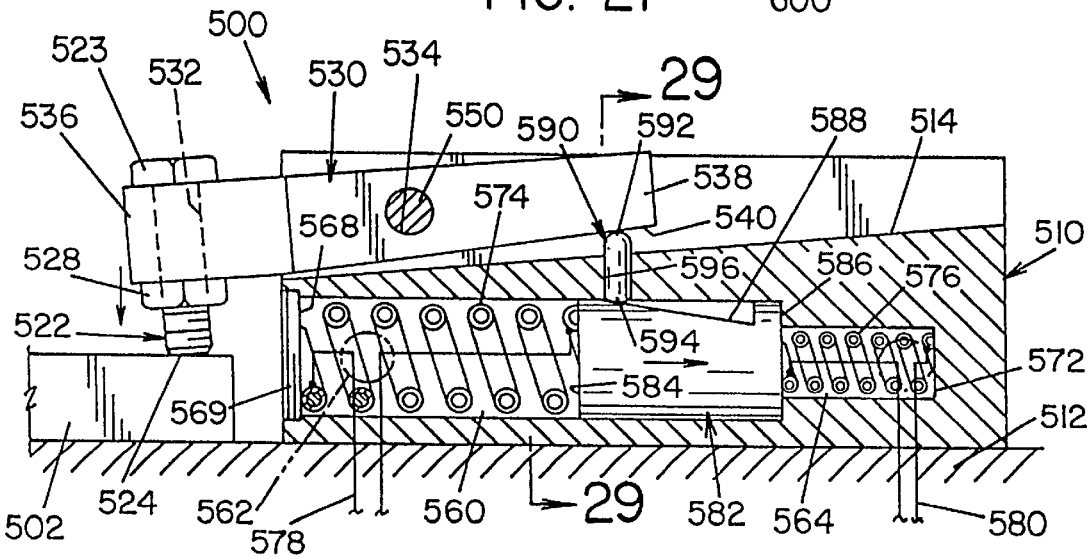
FIG. 28 is a cross-sectional view taken along line 28:28 of FIG. 26 which illustrates the clamp in a clamped position; and, FIG. 29 is a cross-sectional view taken along line 29:29 of FIG. 28.
Figure 29:
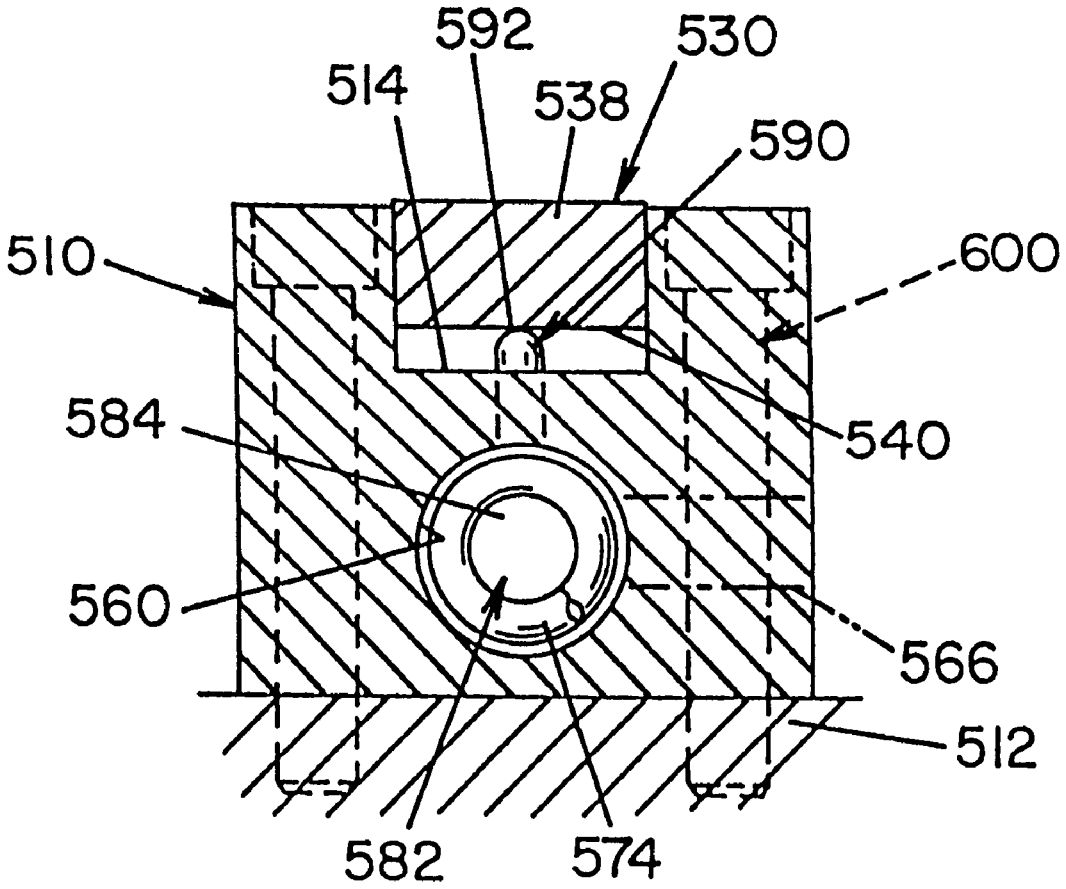

In another embodiment of the present invention, a positive clamping device 500 is illustrated in FIGS. 26–29. Clamp device 500 includes a clamp body 510 mounted onto a bolster plate 512. Clamp body 510 includes four fastener cavities 516. The fastener cavities are sized to allow the body of a securing lug 600 to pass through the clamp body and to engage a threaded plate cavity in the bolster plate. The securing lug includes a threaded end 604 and a lug head 602. A portion of the top side of the fastener cavity can be sized so as to allow the lug head 602 to fit inside the portion of the expanded cavity. The lug head includes a lug slot 606 adapted to receive a tool for turning the securing lug so that the secure lug can fasten clamp body 510 to bolster plate 512. Clamp body 510 includes a clamp arm slot 514, longitudinally positioned at the top of the clamp body and between the two sides of the clamp body. The clamp arm slot includes a base surface which slopes upwardly from the front to the rear of the clamp body. A clamp arm is mounted in clamp arm slot 514 and is rotatably mounted to clamp body 510. Clamp arm 530 includes a connector opening 534 which traverses the longitudinal axis of the clamping arm. The connector opening is adapted to receive a connector pin 550 which is passed through arm slot opening 515 in clamp body 510 and through connector opening 534 of clamp arm 530 thereby rotatably connecting clamp arm 530 to clamp body 510 to allow for rotation of clamp arm 530 in clamp arm slot 514. Clamp arm 530 includes an arm head 536 which includes a pin opening 532 passing through the top and bottom ends of the arm head. A clamping pin 522 is inserted through pin opening 532 and is secured in the pin opening at the bottom side of arm head 536 by a pin bolt 528. The clamping pin includes a pin head 523 at the top of the pin which prevents the top of the pin from passing through pin opening 532 at the top of the arm head 536. At the bottom of clamping pin 522 is a pin face adapted to engage a workpiece and clamp a workpiece between the pin face and bolster plate 512 as illustrated in FIGS. 27 and 28. Clamp arm 530 also includes a clamp end 538 having a bearing surface 540 facing the base of clamp arm slot 514. Clamp body 510 also includes a shuttle chamber 560 positioned in the interior of the clamp body and beneath clamp arm slot 514. Rearwardly of shuttle chamber 560 is a narrower spring chamber 564. Shuttle chamber 560 is adapted to receive a shuttle 582. Shuttle chamber 560 is sized to allow shuttle 582 to longitudinally move within the shuttle chamber. Positioned in spring chamber 564 is a release spring 576. The release spring is preferably made up of a shape memory alloy. At one end of the spring chamber there is a spring wall 572. The other end of the spring chamber opens up into the larger diameter shuttle chamber. Spring chamber 564 also includes a spring chamber opening 566 providing a passage between the spring chamber and the side of clamp body 510. The spring chamber opening allows for a release spring cable 580 to connect to the release spring or a heating element positioned adjacent to the release spring. The release spring is positioned in the spring chamber so that one end of the release spring engages spring wall 572 and the other end of the release spring engages one end of shuttle 582. Preferably, shuttle 582 includes a spring cavity on release face 586 of shuttle 582 which is adapted to receive the end of release spring 576. At the opposite end from the release face of shuttle 582 there is a compression face 584 which engages one end of compression spring 574. Preferably, compression face 584 includes a compression cavity adapted to receive the end of compression spring 574. The other end of compression spring 574 engages compression wall 568. Compression wall 568 is preferably a removable wall which allows access to the shuttle chamber. Preferably, compression wall 568 includes a threaded end 569 which can be threaded into one end of the shuttle chamber as illustrated in FIG. 28. Shuttle chamber 560 includes a shuttle chamber opening 562 which provides a passageway from the shuttle chamber to the side of clamp body 510. The chamber opening 562 provides an opening for compression spring cable 578 to be attached to compression spring 574 or a heating element positioned closely adjacent to the compression spring. The compression spring is preferably made up of a shape memory alloy. The compression spring preferably has a larger spring modulas than the spring modulas of the release spring. Shuttle 582 includes a sloped notch 588 positioned at the top of the shuttle which has a surface that slopes downwardly from the front to the rear of the shuttle. Shuttle chamber 560 also includes a pin opening 596 which provides a passageway through the top of the shuttle chamber to the clamp arm slot. Pin opening 596 is adapted to receive a bearing pin 590. Bearing pin 590 includes a pin top 592 adapted to engage the bearing surface 540 of clamp arm 530. Pin bottom 594 is adapted to engage the sloped notch 588 of shuttle 582.

The operation of the clamping device will now be described. As illustrated in FIG. 28, the spring modulas of compression spring 574 is larger than the spring modulas of release spring 576 thereby forcing shuttle 582 toward the back end of shuttle chamber 560. The movement of shuttle 582 toward the back end of shuttle chamber 560 causes bearing pin 590 to move upwardly through pin opening 596 and forces arm end 538 upwardly. The upward movement of arm end 538 causes clamp arm 530 to rotate on connection pin 550 which in turn causes arm head 536 to move downwardly causing pin face 524 to engage workpiece 502 and clamp workpiece 502 to bolster plate 512. The force applied by clamping pin 522 onto workpiece 502 can be increased by heating compression spring 574 to cause the compression spring to further expand. This expansion of compression spring 574 is accomplished by providing a current through compression spring cable 578 to heat compression spring 574 and/or a heating element positioned closely adjacent to compression spring 574. When the workpiece 502 is to be removed from clamp device 500, the current, if any, which is being supplied through spring cable 578 is terminated. In addition, the current through spring cable 580 is activated so as to supply a current directly to release spring 576 and/or a heating element positioned closely adjacent to the release spring so as to cause the release spring to expand in size. The expansion of the release spring causes shuttle 582 to move toward the front end of shuttle 560. As shuffle chamber 582 moves toward the front of shuttle chamber 560, bearing pin 590 lowers in pin opening 596 as pin bottom 594 follows the downwardly sloped surface on slope notch 588 of shuttle 582. The downward movement of bearing pin 590 allows arm end 538 to move downwardly thereby causing arm head 536 to move upwardly. The upward movement of arm head 536 results in the disengagement of clamping pin 522 from workpiece 502 thereby allowing the workpiece to be removed from clamping device 500. When a workpiece is to be once again clamped in position, the current supply through spring cable 580 is terminated thereby reducing the heat being supplied to release spring 576. As release spring 576 cools, the spring modulas decreases until it is once again less than the spring modulas of compression spring 574. As the spring modulas of release spring continues to decrease, compression spring 574 forces shuttle 582 to move rearwardly in shuttle chamber 560. The rearward movement of shuttle 582 causes bearing pin 590 to rise within pin opening 596 thereby causing clamp arm 530 to move into a clamping position whereby clamping pin 522 clamps workpiece 502 to bolster plate 512. The clamping force applied by clamping pin 522 onto workpiece 502 can be further increased by heating the compression spring to cause the compression spring to further expand and to force bearing pin 590 further upwardly.

The invention has been described with reference to a preferred embodiments and alternates thereof. It is believed that many modifications and alterations to the embodiments discussed herein will readily suggest themselves to those skilled in the art upon reading and understanding the detailed description of the invention. It is intended to include all such modifications and alterations in so far as they come within the scope of the present invention.

What is claimed is:

1. An apparatus for clamping a workpiece comprising:

a base, an actuator mounted onto said base and cooperatively engaging a clamping member having a clamping head and a clamping arm to move said clamping member between a clamped position wherein said workpiece is held by said clamping head in a clamped state with respect to said base and an unclamped position wherein said workpiece is removeable from said apparatus, and said actuator including a shape memory alloy adapted to return to its substantially original shape when heated.

2. The apparatus of claim 1, wherein said clamping member includes a super elastic alloy.

3. The apparatus of claim 2, wherein said actuator further includes a controlled heat source to apply heat to said shape memory alloy for moving said clamping member.

4. The apparatus of claim 3, wherein said actuator moves said clamping member toward said clamped position when said heat is applied.

5. The apparatus of claim 3, wherein said actuator moves said clamping member toward said unclamped position when said heat is applied.

6. The apparatus of claim 3, wherein said heat source includes a heating mechanism selected from the group consisting of electrical resistance heating, fluid heat exchange heating, chemical reaction heating, convection heating, and radiation heating.

7. The apparatus of claim 3, wherein said shape memory alloy includes nickel and titanium.

8. The apparatus of claim 1, wherein said clamping member is releasably attached to said actuator.

9. The apparatus of claim 2, wherein said shape memory alloy includes nickel and titanium.

10. The apparatus of claim 1, wherein said actuator further includes a controlled heat source to apply heat to said shape memory alloy for moving said clamping member.

11. The apparatus of claim 10, wherein said actuator moves said clamping member toward said clamped position when said heat is applied.

12. The apparatus of claim 10, wherein said actuator moves said clamping member toward said unclamped position when said heat is applied.

13. The apparatus of claim 10, wherein said clamping member is releasably attached to said actuator.

14. The apparatus of claim 3, wherein said clamping member is releasably attached to said actuator.

15. The apparatus of claim 10, wherein said heat source includes a heating mechanism selected from the group consisting of electrical resistance heating, fluid heat exchange heating, chemical reaction heating, convection heating, and radiation heating.

16. The apparatus of claim 10, wherein said shape memory alloy includes nickel and titanium.

17. The apparatus of claim 1, wherein said actuator moves said clamping member toward said clamped position when said actuator is heated.

18. The apparatus of claim 1, wherein said actuator moves said clamping member toward said unclamped position when said actuator is heated.

19. The apparatus of claim 1, wherein said shape memory alloy includes nickel and titanium.

20. The apparatus of claim 2, wherein said clamping member is releasably attached to said actuator.

21. A clamping device for clamping a workpiece comprising:

a base, an actuator mounted onto said base and cooperatively engaging a clamping member having a clamping head and a clamping arm to move said clamping member between a clamped position wherein said workpiece is held by said clamping head in a substantially fixed position relative to said base and an unclamped position wherein said workpiece is removeable from said clamping device, and said actuator including an alloy exhibiting shape memory characteristics in response to applied heat and adapted to return to its substantially original shape when heated.

22. The clamping device of claim 21, wherein said clamping member includes an alloy exhibiting super elastic characteristics and adapted to return to its substantially original shape upon removal of applied deformation forces.

23. The clamping device of claim 22, wherein said actuator moves said clamping device toward said clamped position when heated.

24. The clamping device of claim 22, wherein said actuator moves said clamping device toward said unclamped position when heated.

25. The clamping device of claim 22, wherein said actuator includes nickel and titanium.

26. The clamping device of claim 21, wherein said actuator moves said clamping member toward said clamped position when heated.

27. The clamping device of claim 21, wherein said actuator moves said clamping member toward said unclamped position when heated.

28. The clamping device of claim 21, wherein said actuator includes nickel and titanium.

29. A clamping device for frictional clamping of a workpiece comprising a clamp body clamp, element secured to said clamp body, said clamp element having a clamp head and a clamp arm adapted to engage and secure said workpiece and a shape memory alloy adapted to cause said clamp element to move when said shape memory alloy is heated, said clamp element including a flexible metal material component.

30. The clamping device as defined in claim 29, wherein said shape memory alloy causes said clamp element to move into said clamped state upon heating said shape memory alloy.

31. The clamping device as defined in claim 30, wherein said flexible metal material component includes a super elastic alloy.

32. The clamping device as defined in claim 31, wherein said clamp element and said flexible metal material are positioned at least partially adjacent to one another.

33. The clamping device as defined in claim 32, wherein said super elastic alloy is naturally oriented in a clamped position.

34. The clamping device as defined in claim 32, wherein said super elastic alloy is naturally oriented in an unclamped position.

35. The clamping device as define din claim 29, wherein said shape memory alloy causes said clamp element to move into an unclamped state upon heating said shape memory alloy.

36. The clamping device as defined in claim 35, wherein said flexible metal material component includes a super elastic alloy.

37. The clamping device as defined in claim 36, wherein said clamp element and said flexible metal material are positioned at least partially adjacent to one another.

38. The clamping device as defined in claim 37, wherein said super elastic alloy is naturally oriented in a clamped position.

39. The clamping device as defined in claim 37, wherein said super elastic alloy is naturally oriented in an unclamped position.

40. The clamping device as defined in claim 29, wherein said flexible metal material component includes a super elastic alloy.

41. The clamping device as defined in claim 40, wherein said super elastic alloy is naturally oriented in a clamped position.

42. The clamping device as defined in claim 40, wherein said super elastic alloy is naturally oriented in an unclamped position.

43. The clamping device as defined in claim 29, wherein said clamp element and said flexible metal material are positioned at least partially adjacent to one another.

44. The clamping device as defined in claim 29, including a heating mechanism to heat said shape memory alloy.

45. The clamping device as defined in claim 44, wherein said heating mechanism includes electrical resistance heating, fluid heat exchange heating, chemical reaction heating, thermal heating and combinations thereof.

46. A clamping device for frictional clamping of a workpiece comprising a clamp element having a clamp head and a clamp arm adapted to frictionally clamp the workpiece and a first and a second shape memory alloy adapted to move said claim element when at least one of said shape memory alloys is heated, said first shape memory alloy adapted to move said clamp head into a clamped position upon being heated, said second shape memory alloy adapted to move said clamp head into an unclamped position upon being heated.

47. The clamping device as defined in claim 46, wherein said first shape memory alloy applies an opposing force to said second shape memory alloy.

48. The clamping device as defined in claim 47, wherein said first shape memory alloy applies a greater force than said second shape memory alloy when both shape memory alloys are in an unheated state.

49. The clamping device as defined in claim 47, wherein said second shape memory alloy applies a greater force than said first shape memory alloy when both shape memory alloys are in an unheated state.

50. The clamping device as defined in claim 46, wherein said first shape memory alloy applies a greater force than said second shape memory alloy when both shape memory alloys are in an unheated state.

51. The clamping device as defined in claim 46, wherein said second shape memory alloy applies a greater force than said first shape memory alloy when both shape memory alloys are in an unheated state.

* * * * *